US011007565B2

(12) United States Patent
Yabuguchi et al.

(10) Patent No.: US 11,007,565 B2
(45) Date of Patent: May 18, 2021

(54) FASTENING TOOL

(71) Applicant: MAKITA CORPORATION, Anjo (JP)

(72) Inventors: Michisada Yabuguchi, Anjo (JP); Toshihito Yabunaka, Anjo (JP)

(73) Assignee: MAKITA CORPORATION, Anjo (JP)

( * ) Notice: Subject to any disclaimer, the term of this patent is extended or adjusted under 35 U.S.C. 154(b) by 185 days.

(21) Appl. No.: 16/476,249

(22) PCT Filed: Jan. 9, 2018

(86) PCT No.: PCT/JP2018/000223

§ 371 (c)(1),
(2) Date: Jul. 5, 2019

(87) PCT Pub. No.: WO2018/131577

PCT Pub. Date: Jul. 19, 2018

(65) Prior Publication Data

US 2019/0351477 A1 Nov. 21, 2019

(30) Foreign Application Priority Data

Jan. 13, 2017 (JP) ..... JP2017-004672

(51) Int. Cl.
*B21J 15/26* (2006.01)
*B21J 15/10* (2006.01)
(Continued)

(52) U.S. Cl.
CPC ..... *B21J 15/26* (2013.01); *B21J 15/045* (2013.01); *B21J 15/105* (2013.01); *B21J 15/28* (2013.01); *B21J 15/285* (2013.01); *B21J 15/022* (2013.01)

(58) Field of Classification Search
CPC ..... B21J 15/022; B21J 15/043–15/045; B21J 15/105; B21J 15/26; B21J 15/28–285
See application file for complete search history.

(56) References Cited

U.S. PATENT DOCUMENTS 5,655,289 A * 8/1997 Wille ..... B21J 15/26 29/243.53
2010/0206598 A1* 8/2010 Elsmark ..... B25B 27/0014 173/176

(Continued)

FOREIGN PATENT DOCUMENTS

CN 101360920 A 2/2009
CN 104903022 A 9/2015

(Continued)

OTHER PUBLICATIONS

Apr. 3, 2018 International Search Report issued in International Patent Application No. PCT/JP2018/000223.

(Continued)

*Primary Examiner* — Matthew P Travers
(74) *Attorney, Agent, or Firm* — Oliff PLC

(57) ABSTRACT

A fastening tool using a fastener of a type which is configured such that swaging is completed while an end region of a shaft part of a bolt remains integrated with the shaft part, and more particularly, a technique that may help provide a compact device structure while facilitating output management required for swaging, in the fastening tool. The fastening tool is configured to fasten a workpiece with a bolt and a collar without breaking a shaft part of the bolt, and a control part performs swaging operation while controlling the driving current of a motor to become a specified target current value and completes the swaging operation based on rotation speed of the motor.

8 Claims, 14 Drawing Sheets

(51) Int. Cl.

| | |
|---|---|
| ***B21J 15/28*** | (2006.01) |
| ***B21J 15/04*** | (2006.01) |
| ***B21J 15/02*** | (2006.01) |

(56) References Cited

U.S. PATENT DOCUMENTS

| | | | | |
|---|---|---|---|---|
| 2010/0257720 | A1* | 10/2010 | Schiffler | B21J 15/26 29/525.06 |
| 2015/0074964 | A1 | 3/2015 | Masugata | |
| 2016/0114383 | A1* | 4/2016 | Honsel | B21J 15/26 29/525.07 |
| 2019/0283110 | A1* | 9/2019 | Kawai | B21J 15/022 |

FOREIGN PATENT DOCUMENTS

| | | | |
|---|---|---|---|
| DE | 10 2005 054 048 | A1 | 5/2007 |
| EP | 2 985 094 | A1 | 2/2016 |
| JP | S52-131697 | U | 10/1977 |
| JP | H05092300 | A | 4/1993 |
| JP | 2010-509547 | A | 3/2010 |
| JP | 2013-248643 | A | 12/2013 |
| WO | 02/23056 | A | 3/2002 |
| WO | 2008/054397 | A1 | 5/2008 |

OTHER PUBLICATIONS

Apr. 21, 2020 Office Action issued in Japanese Patent Application No. 2018-561371.

May 6, 2020 Office Action issued in Chinese Patent Application No. 201880006230.5.

Jul. 16, 2019 International Preliminary Report on Patentability issued in International Patent Application No. PCT/JP2018/000223.

Sep. 9, 2020 Extended Search Report issued in European Patent Application No. 18738826.9.

* cited by examiner

FASTENING TOOL

TECHNICAL FIELD

The present invention relates to a fastening tool which uses a fastener including a bolt and a cylindrical hollow collar that is engageable with the bolt, the bolt having a head part integrally formed with a shaft part having a groove, to fasten a workpiece between the head part and the collar.

BACKGROUND ART

As for a fastening operation of a workpiece using the fastener configured as described above, two types are known. Firstly, swaging operation may be completed while an end region of the shaft part of the bolt remains integrated with the shaft part. Secondly, swaging operation may be completed while the end region of the shaft part is broken and removed from the shaft part. The former type (first type) may be advantageous in that an additional process of reapplying a coating agent to a broken part can be omitted since the fastening operation is performed without breaking the shaft part. The latter type (second type) may be advantageous in that the fastener is reduced in height when the swaging operation is completed since the end region of the shaft part is broken and removed.

As an example of a fastening tool using a fastener of the above-described first type, WO 2002/023056 discloses a fastening tool, including a bolt-gripping part configured to grip an end region of a shaft part, and an anvil configured to be engaged with a collar. The bolt-gripping part is moved relative to the anvil by utilizing fluid pressure generated by a piston-cylinder, so that the anvil presses the collar and the workpiece is clamped between the collar and the head part.

In the fastening tool for fastening a workpiece using a fastener of the above-described first type, close output management is required in a swaging operation, in order to perform the swaging operation without breaking the end region of the shaft part. In the above-described fastening tool, output is controlled utilizing the fluid pressure, which facilitates the output control required for swaging, but it is difficult to realize a simple and compact device structure.

Further, apart from the above-described fasteners, an electric fastening tool using a so-called blind rivet is also known as disclosed, for example, in Japanese Unexamined Patent Application Publication No. 2013-248643. In this case, the fastening operation using the blind rivet is completed with the shaft part broken, so that there is little need for close output management which is required in swaging the fastener of the above-described first type.

SUMMARY OF THE INVENTION

Problems to be Solved by the Invention

Accordingly, it is an object of the present invention to provide a fastening tool using a fastener of the above-described first type, which is configured such that swaging is completed while an end region of a shaft part of a bolt remains integrated with the shaft part, and more particularly to provide a technique that may help provide a compact device structure while facilitating output management required for swaging, in the fastening tool.

Embodiment to Solve the Problem

A fastening tool according to the present invention is provided in order to solve the above-described problem. The fastening tool uses a fastener including a bolt and a cylindrical hollow collar that is engageable with the bolt, the bolt having a head part integrally formed with a shaft part having a groove, to fasten a workpiece between the head part and the collar. The bolt may also be referred to as a pin with a head part.

The fastening tool according to the present invention includes a bolt-gripping part, an anvil, a motor and a control part. The bolt-gripping part is configured to grip an end region of the shaft part. The anvil is configured to be engaged with the collar. The motor is configured to drive and move the bolt-gripping part relative to the anvil in a specified longitudinal-axis direction. The control part is configured to control driving of the motor.

In the present invention, when the bolt-gripping part grips the end region of the shaft part and moves relative to the anvil in a specified first direction of the longitudinal-axis direction, the anvil presses the collar fitted onto the shaft part in a second direction opposite to the first direction of the longitudinal-axis direction and inward in a radial direction of the collar. Thus, swaging of the fastener is started. The fastening tool is configured to clamp the workpiece between the collar and the head part and to crimp a hollow part of the collar to the groove, whereby swaging of the fastener is completed while the end region remains integrated with the shaft part.

In the present invention, the bolt-gripping part for gripping the end region of the shaft part of the bolt is configured to move in the specified longitudinal-axis direction via the motor relative to the anvil engaged with the collar. With this structure, the fastening tool with a simple and compact structure can be realized, compared with a fastening tool utilizing fluid pressure.

Further, in the present invention, the control part is configured to perform swaging of the fastener by driving the bolt-gripping part in the first direction while controlling driving current of the motor to become a specified target current value.

When fastening a workpiece using the fastener, high output is required to plastically deform and swage the collar. If this output is insufficient, the collar may be insufficiently plastically deformed and thus insufficiently swaged. On the other hand, if this output is excessive, equipment breakage may be caused by a strong force applied to the bolt-gripping part or the shaft part of the bolt.

In the present invention, therefore, the fastener is swaged by the bolt-gripping part being driven in the first direction while the driving current of the motor is controlled to become the specified target current value.

The manner of "becoming a specified target current value" may typically represent a manner of performing feedback control of the driving current of the motor based on a specified target current value. Further, in order to reliably avoid equipment breakage due to excessive motor output, it may be preferable, particularly from the viewpoint of preventing excessive output, to control driving of the motor such that the driving current of the motor does not exceed the specified target current value, at least just before completion of swaging operation when the plastic deformation of the collar is close to its limit.

By performing swaging operation while controlling the driving current of the motor to become the specified target current value, the risk of occurrence of defect (insufficient fastening) due to excessively small driving current of the motor and the risk of occurrence of defect (equipment breakage) due to excessively large driving current of the motor can both be eliminated. Thus, output can be optimized while the control system is avoided from becoming complicated. Specifically, by provision of this structure, the control can be performed with a simple structure to secure output which is necessary and sufficient to fasten the fastener and to avoid the risk of equipment breakage.

As for the setting of the "specified target current value" in the present invention, for example, a manner of setting a preset specified value as the target current value as part of a so-called constant current control of the motor may be suitably adopted. Further, it may also suitably include a manner in which a plurality of target current values are sequentially set in the fastening operation, a manner in which a target current value changes curvilinearly or continuously and a manner in which there exist an area in which a target current value is set and an area in which a target current value is not set in the process of performing the fastening operation.

Further, the control part of the present invention is configured to complete swaging of the fastener by stopping driving of the bolt-gripping part based on rotation speed of the motor. When controlling driving of the motor based on the specified target current value, output can be optimized, but it may be necessary to separately set the timing of completing swaging operation. In the present invention, swaging operation is completed by stopping driving of the bolt-gripping part in the first direction based on the rotation speed of the motor.

The manner of completing swaging operation "based on rotation speed of the motor" may suitably include a manner of completing swaging operation when the rotation speed of the motor is reduced to a specified low speed or when the rotation speed of the motor is reduced to zero, for example, in response to a state in which the fastener cannot plastically deform any further. By provision of such a structure, swaging operation can be completed when inertial force generated by rotation of the motor is sufficiently reduced or when the motor is stopped and the inertial force is reduced to zero, so that the need for controlling the motor rotating at high speed to quickly stop can be eliminated. Thus, this structure may be excellent in control efficiency and equipment protection.

Further, the manner based on the "rotation speed of the motor" may suitably include not only a manner literally based on the number of revolutions of the motor per unit time, but also a manner based on an amount of change (for example, a differential or a difference) in the rotation speed of the motor, a manner based on the accumulated number of revolutions of the motor, that is, based on a lapse of a specified period of time in driving of the motor, and manners based on voltage drop, internal resistance or other various values in the driving power source of the motor, that is, indicators having correlation with the rotation speed of the motor.

As the "motor" in the present invention, a compact brushless motor having high output may be suitably employed, but it is not limited to this.

Further, a direct current (DC) battery which can be mounted to the fastening tool may be suitable as means for supplying driving current for the motor, but, for example, an alternate current (AC) power source may also be employed.

As the "driving current of the motor" which is one of the objects to be controlled in the present invention, for example, a current value in a motor drive circuit of the fastening tool, or an output current value in a battery if the battery is used as a driving source, may be appropriately employed.

The "workpiece" in the present invention may typically consists of a plurality of members to be fastened each having a through hole, and the members to be fastened may be suitably formed of metal material requiring fastening strength. In this case, it may be preferable that the members to be fastened which have respective through holes are superimposed such that the through holes are aligned with each other, or the members to be fastened are superimposed and then the through holes are formed therethrough. In this state, it may be preferable that the shaft part of the bolt of the fastener is inserted through the through holes, and the fastener is set such that the head part of the bolt is arranged on one end side of the aligned through holes and the collar is arranged on the other end side.

The "fastening tool" according to the present invention may be suitably used in cases where a workpiece needs to be fastened with especially high strength, for example, such as in manufacturing transport equipment such as aircrafts and automobiles, and in fastening an installation base for a solar panel or a plant.

The "bolt-gripping part" in the present invention may comprise a plurality of claws (also referred to as a jaw) which can be engaged with the end region of the shaft part.

In the present invention, the "groove" to which the hollow part of the collar is crimped (swaged) may be formed at least in a crimping position of the shaft part, but groove(s) may be formed elsewhere in the shaft part or over the whole length of the shaft part. The groove(s) formed in a position other than the crimping position may be used, for example, to position or temporarily fix the collar.

The "anvil" in the present invention may preferably be a metal anvil configured to deform the collar by a swaging force and may preferably have a bore (open hollow part) which has a tapered part for receiving the outer periphery of the collar. Specifically, the anvil may preferably be configured such that the bore has a diameter smaller than the outer diameter of a swaging region of the collar, while an opening of the tapered part formed in the bore has a diameter larger than the outer diameter of the swaging region of the collar so that the collar can be guided into the bore. By provision of this structure, when the bolt-gripping part moves in a fastening direction relative to the anvil, the anvil abuts on the opening of the tapered part and presses the collar in the longitudinal-axis direction, and along with further relative movement of the bolt-gripping part, the collar proceeds into the bore of the anvil while being pressed radially inward by the tapered part. As a result, the collar clamps the workpiece in cooperation with the head part, and is pressed radially inward by the bore of the anvil and deformed to be reduced in diameter, so that the hollow part of the collar is crimped (swaged) into the groove of the shaft part. Thus, the collar is swaged onto the bolt and the workpiece is fastened by the fastener.

In a preferred aspect of the invention, the control part may be configured to drive the bolt-gripping part while controlling the driving current of the motor to become the target current value from start to completion of swaging operation of the fastener.

From start to completion of swaging operation, the collar may be pressed while being deformed. By controlling the driving current of the motor to become the target current value during this period, insufficient swaging due to insufficient output can be avoided and equipment breakage due to excessive output can also be avoided. The start of the swaging operation of the fastener may be appropriately detected, for example, by detecting decrease in the rotation speed of the motor, or increase in the driving current of the motor as the collar is pressed.

In a preferred aspect of the invention, the fastening tool may include an operation member which is configured to be manually turned on by a user to drive the motor. Further, the control part may be configured to drive the bolt-gripping part while controlling the driving current of the motor to become the target current value until swaging of the fastener is completed after the operation member is turned on. A typical preferable example of the "operation member" may be a trigger which can be depressed by a user.

With this structure, control of the driving current of the motor to become the target current value can be started based on an easily detectable operation that a user manually turns on the operation member to drive the motor, so that the motor drive control can be avoided from becoming complicated.

In a preferred aspect of the invention, the control part may be configured to stop driving of the bolt-gripping part to complete swaging of the fastener when the rotation speed of the motor is reduced to a specified rotation speed. Further, in a preferred aspect of the invention, the control part may be configured to stop driving of the bolt-gripping part to complete swaging of the fastener when the motor stops rotating.

These aspects are specific examples of the structure of completing swaging "based on the rotation speed of the motor" in the present invention. When controlling the driving current of the motor to become the target current value, the target current value may be optimized such that a motor output required for swaging is obtained while avoiding equipment breakage. Therefore, when the fastener becomes unable to plastically deform any further near completion of swaging, it may be expected that the bolt-gripping part becomes unable to move in the first direction relative to the anvil while driving current is applied to the motor. From this state, it can be determined that fastening is completed, and swaging of the fastener can be reliably completed. Thus, the swaging operation can be completed when inertial force generated by rotation of the motor is sufficiently reduced or when the motor is stopped and the inertial force of the motor is reduced to zero, so that this structure may be excellent in control efficiency and equipment protection.

In a preferred aspect of the invention, the target current value may be adjustable.

A fastening force (an axial force) required for swaging of the fastener may be different depending on whether the fastener for fastening the workpiece is formed of a relatively soft material such as aluminum or a relatively hard material such as steel. Therefore, the driving current of the motor may be required to correspond to the required axial force, and accordingly, it may be preferable that the target current value can also be changed and adjusted. The manner of being "changed and adjusted" may suitably include a manner of being manually changed and adjusted by a user's operation and a manner of being automatically changed and adjusted based on a result of detection of an object to be fastened or other fastening conditions.

In a preferred aspect of the present invention, an initial position may be set in which the bolt-gripping part is placed in a specified position relative to the anvil, and the control part may be configured to move the bolt-gripping part in the second direction relative to the anvil, when swaging of the fastener is completed, to return the bolt-gripping part to the initial position by controlling the motor to be driven at a specified target rotation speed.

In the present aspect, in the swaging operation of the fastener, the driving current of the motor is controlled to become the target current value, so that motor output required for swaging can be secured while breakage of the fastening tool or the fastener is prevented. After completion of swaging, when returning the fastening tool to an initial state in order to make the fastening tool ready for the next fastening operation, it may not be necessary to consider a risk of such equipment breakage and it may be rather rational to speed up return of the fastening tool to the initial state. In consideration of this point, when swaging of the fastener is completed, the control part may return the bolt-gripping part to the initial position by controlling the motor to be driven at a specified target rotation speed. As for the manner of driving at "a specified target rotation speed", a manner of driving the motor by so-called constant rotation control may typically be adopted. Further, in the return operation, it may also suitably include a manner in which a plurality of target rotation speeds are sequentially set and a manner in which the target rotation speed is changed curvilinearly or continuously.

In a preferred aspect of the invention, an initial position may be set in which the bolt-gripping part is placed in a specified position relative to the anvil, and the control part may be configured to move the bolt-gripping part in the second direction relative to the anvil to return the bolt-gripping part to the initial position after stopping movement of the bolt-gripping part in the first direction relative to the anvil based on the rotation speed of the motor.

The present aspect can be rephrased that the control part may be configured to automatically (without the need of any instruction to the control part) start relative movement of the bolt-gripping part in the second direction. Further, any instruction to the control part may be inputted into the control part via an operation member (for example, an operation member for driving the motor) which is configured to be manually operated by a user. According to the present aspect, the control part can promptly return the fastening tool to the initial position after completion of swaging. Therefore, working efficiency can be improved when the fastening operation using the fastener is continuously performed a plurality of times. It is noted that the control part can start relative movement of the bolt-gripping part in the second direction immediately or after the lapse of a specified time after stopping relative movement of the bolt-gripping part in the first direction.

Effect of the Invention

According to the present invention, a fastening tool is provided using a fastener of a type which is configured such that swaging is completed while an end region of a shaft part of a bolt remains integrated with the shaft part, and more particularly, a technique is provided which may help provide a compact device structure while facilitating output management required for swaging, in the fastening tool.

DESCRIPTION OF EMBODIMENT

A fastening tool for fastening a workpiece via a fastener is now explained as an embodiment of the present invention with reference to the drawings.

Figure 1:
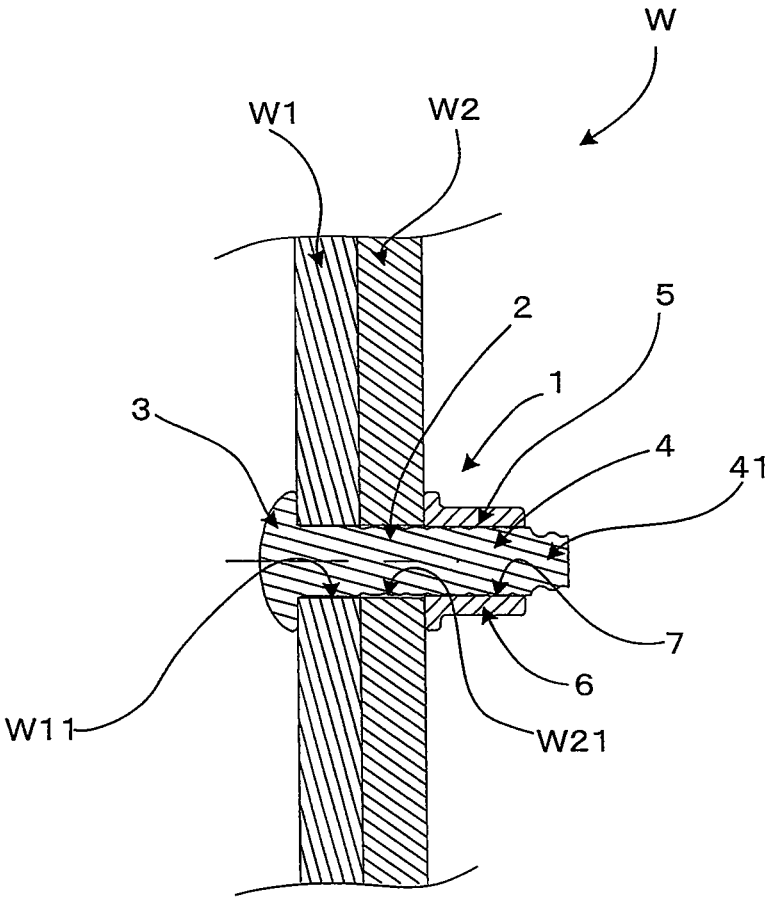
FIG. 1 is a sectional front view showing a workpiece and a fastener according to an embodiment of the present invention.

FIG. 1 shows a workpiece W and a fastener 1 according to an embodiment of the present invention. In the present embodiment, as an example, the workpiece W consists of plate-like metal members W1 and W2 to be fastened. The members W1 and W2 to be fastened are superimposed such that through holes W11 and W21 respectively formed in advance in the members W1 and W2 to be fastened are aligned with each other.

The fastener 1 mainly includes a bolt 2 and a collar 6. The bolt 2 has a head 3 and a bolt shaft 4. The bolt shaft 4 is integrally formed with the head 3 and has grooves 5 formed in its outer periphery. The head 3 is an example that corresponds to the "head part" according to the present invention. The grooves 5 are formed substantially over the whole length in an axial direction of the bolt shaft 4. The collar 6 has a cylindrical shape having a hollow collar part 7. The collar 6 may be engaged with the bolt 2 by inserting the bolt shaft 4 through the hollow collar part 7. An inner wall of the hollow collar part 7 is formed as a smooth surface. Although not particularly shown, the inner wall of the hollow collar part 7 has an engagement part for temporarily fixing the collar 6 fitted onto the bolt shaft 4. In FIG. 1, the fastener 1 is shown with the collar 6 temporarily fixed in engagement with the grooves 5 of the bolt shaft 4.

Figure 2:
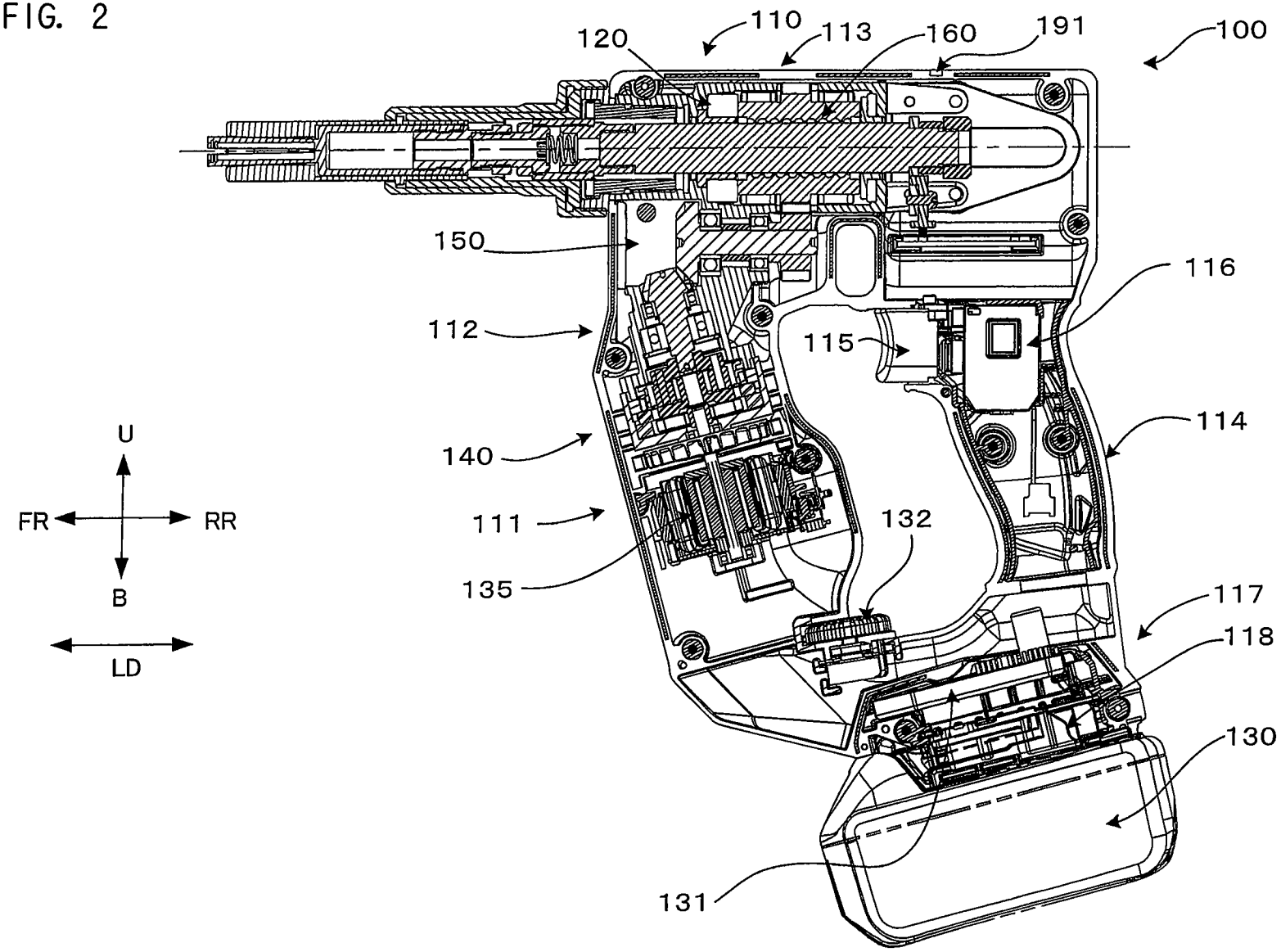
FIG. 2 is a sectional front view showing the whole structure of a fastening tool according to the embodiment of the present invention.

FIG. 2 shows the whole structure of the fastening tool 100 according to the present embodiment of the invention. The fastening tool 100 may also be referred to as a riveter or lock bolt tool.

In the following description, the symbol "FR" is defined as a front side direction (left side direction on the paper face of FIG. 2) of the fastening tool 100, the symbol "RR" a rear side direction (right side direction on the paper face of FIG. 2), the symbol "U" an upper side direction (upper side direction on the paper face of FIG. 2), the symbol "B" an lower side direction (lower side direction on the paper face of FIG. 2), the symbol "L" a left side direction (lower side direction on the paper face of FIG. 5), the symbol "R" a right side direction (upper side direction on the paper face of FIG. 5), and the symbol "LD" an extending direction of a longitudinal axis of the fastening tool, that is, a longitudinal-axis direction (left-right direction on the paper face of FIG. 2), and the symbols are appropriately shown in the drawings.

The rear side direction RR, the front side direction FR and the longitudinal-axis direction LD in the present embodiment are examples that correspond to the "first direction", the "second direction" and the "longitudinal-axis direction", respectively, according to the present invention.

As shown in FIG. 2, an outer shell of the fastening tool 100 mainly includes an outer housing 110 and a grip part 114 connected to the outer housing 110.

The outer housing 110 mainly includes a motor housing region 111 for housing a motor 135, an inner-housing housing region 113 for housing an inner housing 120, and a controller housing region 117 for housing a controller 131. The inner housing 120 is a housing member for a planetary-gear speed-reducing mechanism 140, a bevel-gear speed-reducing mechanism 150 and a ball-screw mechanism 160, which will be described in detail later. A battery mounting part 118 is provided on a lower end of the controller housing region 117 and configured such that a battery 130, which serves as a driving power source for the motor 135, can be removably connected to the fastening tool 100.

In FIG. 2, a region adjacent to the motor housing region 111 in the inner-housing housing region 113 is shown as a speed-reducing-gear housing region 112 for housing the planetary-gear speed-reducing mechanism 140 and the bevel-gear speed-reducing mechanism 150.

Further, an operation dial 132 for setting a target current value relating to a driving current of the motor 135 is provided in a connecting region between the motor housing region 111 and the controller housing region 117. Although not particularly shown, an indication of setting values which correspond to target current values (in a stepless level in the present embodiment) is printed on a display part of an upper surface of the operation dial 132, so that a user can select any setting value by manually operating the operation dial 132. Details about the target current value will be described later.

Further, an LED 191 for indicating completion of a fastening operation by emitting light is provided on an upper surface of the outer housing 110.

A trigger 115 which is configured to be manually operated by a user and an electric switch assembly 116 which is configured to be turned on and off in response to the manual operation of the trigger 115 are arranged in the grip part 114.

The controller housing region 117, the motor housing region 111, the inner-housing housing region 113 (including the speed-reducing-gear housing region 112) and the grip part 114 are contiguously arranged to form a closed loop.

Figure 3:
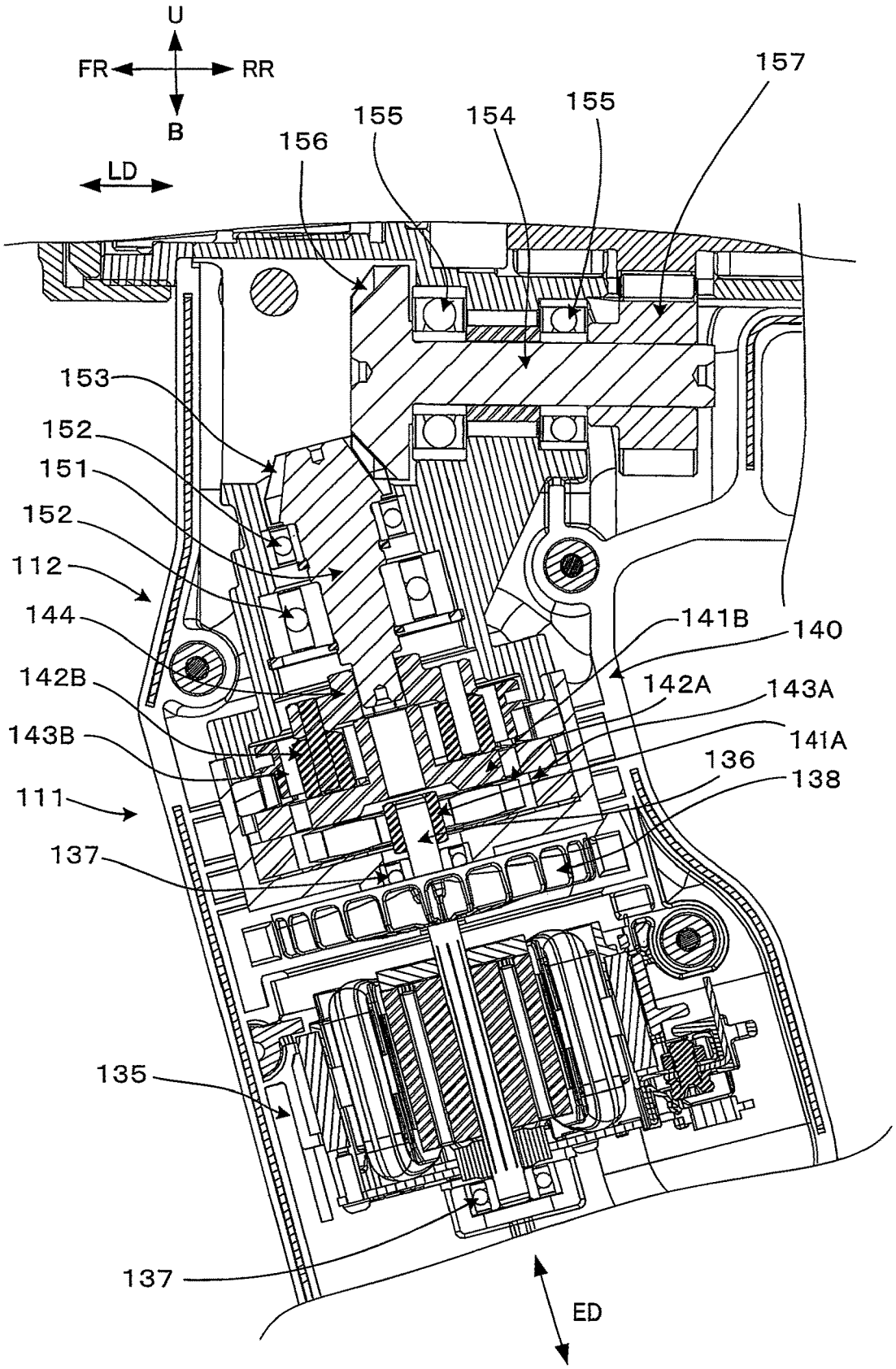
FIG. 3 is a partial sectional view showing the partial structure of an outer housing of the fastening tool.

FIG. 3 shows the structures of the motor housing region 111 and the speed-reducing-gear housing region 112 in detail.

A DC brushless motor is employed as the motor 135 which is housed in the motor housing region 111. A motor output shaft 136, to which a cooling fan 138 is mounted, is rotatably supported by bearings 137 at both end regions. One end of the motor output shaft 136 is connected to a first sun gear 141A of the planetary-gear speed-reducing mechanism 140 so that the motor output shaft 136 and the first sun gear 141A integrally rotate.

The planetary-gear speed-reducing mechanism 140, which is housed in the speed-reducing-gear housing region 112, is of a two-stage speed reduction type. The first speed reduction stage of the planetary-gear speed-reducing mechanism 140 mainly includes the first sun gear 141A, a plurality of first planetary gears 142A and a first internal gear 143A. The first planetary gears 142A are engaged with the first sun gear 141A, and the first internal gear 143A is engaged with the first planetary gears 142A. Further, the second speed reduction stage of the planetary-gear speed-reducing mechanism 140 mainly includes a second sun gear 141B, a plurality of second planetary gears 142B, a second internal gear 143B and a carrier 144. The second sun gear 141B also serves as a carrier of the first planetary gears 142A. The second planetary gears 142B are engaged with the second sun gear 141B. The second internal gear 143B is engaged with the second planetary gears 142B. The carrier 144 is rotated along with revolving movement of the second planetary gears 142B.

The carrier 144 is connected to a drive-side intermediate shaft 151 of the bevel-gear speed-reducing mechanism 150, so that the carrier 144 and the drive-side intermediate shaft 151 integrally rotate. The bevel-gear speed-reducing mechanism 150 is housed adjacent to the planetary-gear speed-reducing mechanism 140 within the speed-reducing-gear housing region 112.

The bevel-gear speed-reducing mechanism 150 mainly includes the drive-side intermediate shaft 151, a drive-side bevel gear 153, a driven-side intermediate shaft 154, a driven-side bevel gear 156 and a ball-nut drive gear 157. The drive-side intermediate shaft 151 is supported at both ends by bearings 152. The drive-side bevel gear 153 is provided on the drive-side intermediate shaft 151. The driven-side intermediate shaft 154 is supported at both ends by bearings 155. The driven-side bevel gear 156 and the ball-nut drive gear 157 are provided on the driven-side intermediate shaft 154. The "intermediate shaft" here refers to an intermediate shaft provided on a path for transmitting rotation output of the motor 135 from the motor output shaft 136 to the ball-screw mechanism 160, which will be described later (see FIG. 4). An extending direction ED of the motor output shaft 136 and the drive-side intermediate shaft 151 obliquely crosses an extending direction of the driven-side intermediate shaft 154, which is the longitudinal-axis direction LD.

Figure 4:
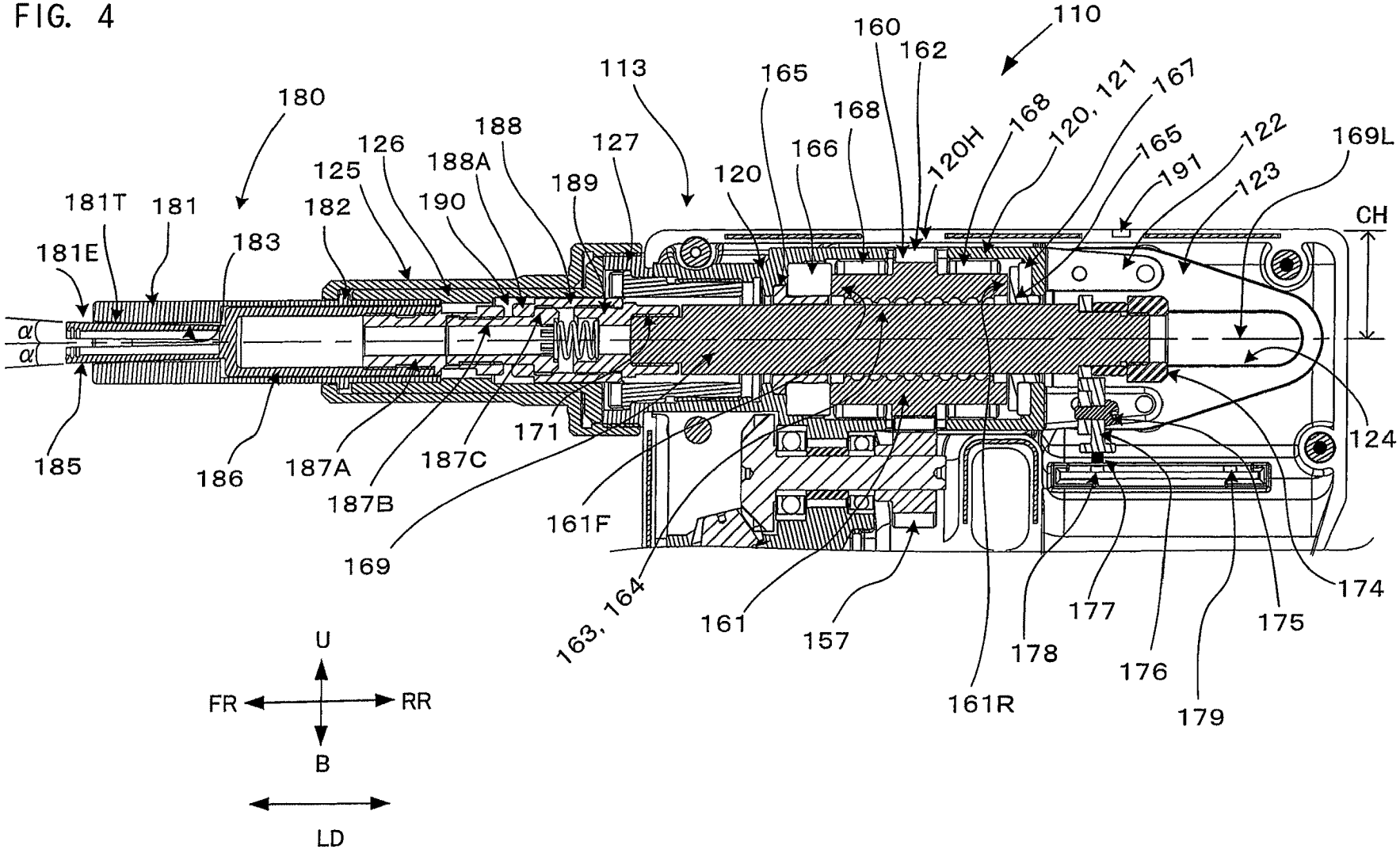
FIG. 4 is a partial sectional view showing the detailed structure of an inner housing of the fastening tool.
Figure 5:
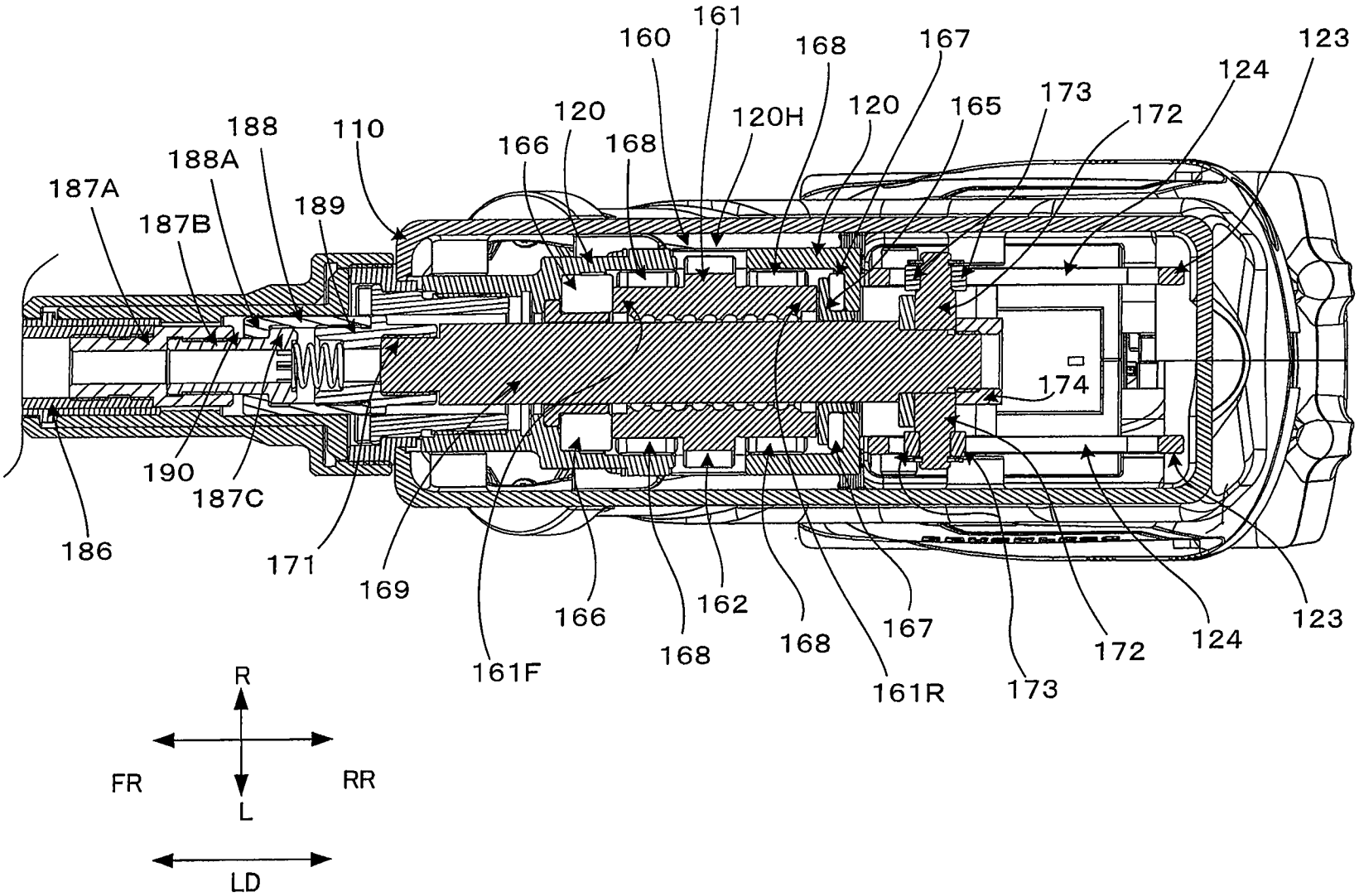
FIG. 5 is a sectional plan view corresponding to the partial sectional view of FIG. 4.

FIGS. 4 and 5 show the structure of the inner-housing housing region 113 in detail. As described above, the inner housing 120, which is housed in the inner-housing housing region 113, is a housing member for the planetary-gear speed-reducing mechanism 140, the bevel-gear speed-reducing mechanism 150 and the ball-screw mechanism 160. In the present embodiment, a region for housing the planetary-gear speed-reducing mechanism 140 in the inner housing 120 is formed of resin, while a region for housing the bevel-gear speed-reducing mechanism 150 and the ball-screw mechanism 160 is formed of metal. Although not shown for convenience sake, the both regions are integrally connected to each other with screws.

As shown in FIG. 4, guide flanges 123 are connected to an end of the inner housing 120 in the rear side direction RR via guide flange mounting arms 122. The guide flanges 123 each have an elongate guide hole 124 extending in the longitudinal-axis direction LD.

Further, a sleeve 125 for locking an anvil 181 is connected to the other end of the inner housing 120 in the front side direction FR via a joint sleeve 127. The sleeve 125 is formed as a cylindrical body having a sleeve bore 126 extending in the longitudinal-axis direction LD.

The inner housing 120 has a ball-screw housing region 121 which houses the ball-screw mechanism 160.

The ball-screw mechanism 160 mainly includes a ball nut 161 and a ball-screw shaft 169. A driven gear 162 is formed on an outer periphery of the ball nut 161 and engaged with the ball-nut drive gear 157. The driven gear 162 receives the rotation output of the motor from the ball-nut drive gear 157, which causes the ball nut 161 to rotate around the longitudinal axis LD. Further, the ball nut 161 has a bore 163 having a groove part 164 and extending in the longitudinal-axis direction LD.

The ball nut 161 is supported at both ends by the inner housing 120 via a plurality of radial needle bearings 168 spaced apart from each other in the longitudinal-axis direction LD, so that the ball nut 161 is rotatable around the longitudinal axis LD. Further, a thrust ball bearing 166 is disposed between the ball nut 161 and the inner housing 120 on a front end part 161F of the ball nut 161 in the front side direction FR. With this structure, even if an axial force (thrust load) in the longitudinal-axis direction LD is applied to the ball nut 161, the thrust ball bearing 166 allows the ball nut 161 to smoothly rotate around the longitudinal-axis direction LD, while reliably receiving the axial force, thereby avoiding the risk that a strong axial force may impede rotation of the ball nut 161 around the longitudinal-axis direction LD.

Further, a thrust needle bearing 167 is disposed between the ball nut 161 and the inner housing 120 on a rear end part 161R of the ball nut 161 in the rear side direction RR. With this structure, even if an axial force (thrust load) in the longitudinal-axis direction LD is applied to the ball nut 161, the thrust needle bearing 167 allows the ball nut 161 to rotate around the longitudinal-axis direction LD, while reliably receiving the axial force in the longitudinal-axis direction LD, thereby avoiding the risk that a strong axial force may adversely affect rotation of the ball nut 161 around the longitudinal-axis direction LD. In the present embodiment, a thrust washer 165 is further disposed between the ball nut 161 and the thrust ball bearing 166, and also between the ball nut 161 and the thrust needle bearing 167.

As shown in FIG. 4, the thrust ball bearing 166 and the thrust needle bearing 167 are each configured to have a diameter larger than an outer diameter of the ball nut 161 at the front and rear end parts 161F and 161R of the ball nut 161. In this manner, the axial force (thrust load) applied to the ball nut 161 per unit area is avoided from being increased due to reduction of the diameter, so that the operating performance and durability are improved.

Further, as shown in FIGS. 4 and 5, the ball-screw shaft 169 is configured as an elongate body which extends in the longitudinal-axis direction LD. The ball-screw shaft 169 has a groove part (not shown for the convenience sake) formed in its outer periphery. The groove part is engaged with the groove part 164 of the ball nut 161 via balls. The ball-screw shaft 169 is configured to be linearly moved in the longitudinal-axis direction LD by rotation of the ball nut 161 around the longitudinal-axis direction LD. Specifically, the ball-screw shaft 169 serves as a motion converting mechanism for converting rotation of the ball nut 161 around the longitudinal-axis direction LD into linear motion in the longitudinal-axis direction LD.

The outer periphery of the driven gear 162 is dimensioned to be substantially flush with an outer surface of the inner housing 120 through a notch-like hole 120H formed in the inner housing 120. In other words, the driven gear 162 is configured such that the outer periphery of the driven gear 162 is configured not to protrude in the upper side direction U from the outer surface of the inner housing 120. This structure may contribute to reduction in a height (also referred to as a center height) CH from a shaft line 169L of the ball-screw shaft 169 to an outer surface of the outer housing 110 in the upper side direction U.

The ball-screw shaft 169 is integrally connected to a third connection part 189 of a bolt-gripping mechanism 180 (described later) via a threaded engagement part 171 formed in an end region of the ball-screw shaft 169 in the front side direction FR. Further, in an end region of the ball-screw shaft 169 in the rear side direction RR, an end cap 174 is provided, and as shown in FIG. 5, a pair of left and right rollers 173 are provided via left and right roller shafts 172 which are provided adjacent to the end cap 174 and protrude in the left side direction L and the right side direction R, respectively. The rollers 173 is rollably supported by the guide holes 124 of the guide flanges 123, respectively. Therefore, the ball-screw shaft 169 is stably supported in the two different regions in the longitudinal-axis direction LD (supported at the both ends) via the ball nut 161 supported by the inner housing 120 and the guide holes 124 in which the rollers 173 are fitted. The ball-screw shaft 169 may be subjected to rotation torque around the longitudinal-axis direction LD when the ball nut 161 rotates around the longitudinal-axis direction LD. By abutment between the rollers 173 and the guide holes 124, however, the ball-screw shaft 169 can be prevented from being rotated around the longitudinal-axis direction LD due to such rotation torque.

Further, as shown in FIG. 4, a magnet 177 is provided adjacent to the end cap 174 on the ball-screw shaft 169 via an arm mounting screw 175 and an arm 176. The magnet 177 is thus integrally provided on the ball-screw shaft 169, and moves together when the ball-screw shaft 169 moves in the longitudinal-axis direction LD.

In the outer housing 110, an initial-position sensor 178 is provided in a position corresponding to a position in which the magnet 177 is located when the ball-screw shaft 169 is moved to its maximum extent in the front side direction FR as shown in FIG. 4. Further, a rearmost-end-position sensor 179 is provided in a position corresponding to a position in which the magnet 177 is located when the ball-screw shaft 169 is moved to its maximum extent in the rear side direction RR. Each of the initial-position sensor 178 and the rearmost-end-position sensor 179 has a Hall element and forms a position detecting mechanism configured to detect the position of the magnet 177. In the present embodiment, the initial-position sensor 178 and the rearmost-end-position sensor 179 are configured to detect the position of the magnet 177 when the magnet 177 is located within their respective detection ranges. FIG. 4 shows the fastening tool 100 in the "initial position".

As shown in FIG. 4, the bolt-gripping mechanism 180 mainly includes an anvil 181 and bolt-gripping claws 185. The bolt-gripping mechanism 180 or the bolt-gripping claws 185 is an example that corresponds to the "bolt-gripping part" according to the present invention.

The anvil 181 is configured as a cylindrical body having an anvil bore 183 extending in the longitudinal-axis direction LD. The anvil bore 183 has a tapered part 181T extending a specified distance in the longitudinal-axis direction LD from an opening 181E formed at its front end in the front side direction FR. The tapered part 181T has an inclination of angle $\alpha$ so as to be gradually tapered (narrower) in the rear side direction RR.

The anvil 181 is locked to the sleeve 125 and the sleeve bore 126 via a sleeve lock rib 182 formed on an outer periphery of the anvil 181 and is integrally connected to the inner housing 120.

The anvil bore 183 is configured to have a diameter slightly smaller than the outer diameter of the collar 6 shown in FIG. 1 such that the collar 6 may be inserted into the anvil bore 183 from the opening 181E while deforming, only when a fastening force (axial force) which is strong enough to deform the collar 6 is applied The opening 181E of the anvil bore 183 is configured to have a diameter slightly larger than the outer diameter of the collar 6 so as to form an insertion guide part for guiding insertion of the collar 6 into the anvil bore 183.

The tapered part 181T is configured to have a length longer than the height of the collar 6 in the longitudinal-axis direction LD, so that the collar 6 lies within a region in which the tapered part 181T is formed in the longitudinal-axis direction LD even if the collar 6 is inserted into the anvil bore 183 to its maximum extent.

The bolt gripping claws 185 may also be referred to as a jaw. In the present embodiment, although not particularly shown, three such bolt-gripping claws 185 are arranged at equal intervals on an imaginary circumference when viewed in the longitudinal-axis direction LD. The bolt gripping claws 185 are configured to grip a bolt-shaft end region 41 of the fastener 1 shown in FIG. 1. The bolt-shaft end region 41 is an example that corresponds to the "end region" according to the present invention. The bolt-gripping claws 185 are integrally formed with a bolt-gripping-claw base 186. As shown in FIGS. 4 and 5, the bolt-gripping-claw base 186 is connected to the ball-screw shaft 169 via a first connection part 187A, a second connection part 187B, a locking part 188, a third connection part 189 and a threaded engagement part 171. Further, as shown in FIGS. 4 and 5, the second connection part 187B and the locking part 188 are connected together by engagement between a locking flange 187C formed on a rear end of the second connection part 187B and a locking end part 188A formed on a front end of the locking part 188 in the longitudinal-axis direction LD. The locking flange 187C and the locking end part 188A are connected such that the second connection part 187B move together with the third connection part 189 when the third connection part 189 moves in the rear side direction RR. Specifically, when the ball-screw shaft 169 moves in the rear side direction RR, the bolt-gripping claws 185 move together with the ball-screw shaft 169 in the rear side direction RR. On the other hand, when the third connection part 189 moves in the front side direction FR, the third connection part 189 moves relative to the second connection part 187B, corresponding to a space 190 formed in front of the locking end part 188A The ball-screw shaft 169 is configured to have a small-diameter part having the threaded engagement part 171 such that an outer periphery of the third connection part 189 is substantially flush with an outer periphery of the ball-screw shaft 169.

Figure 6:
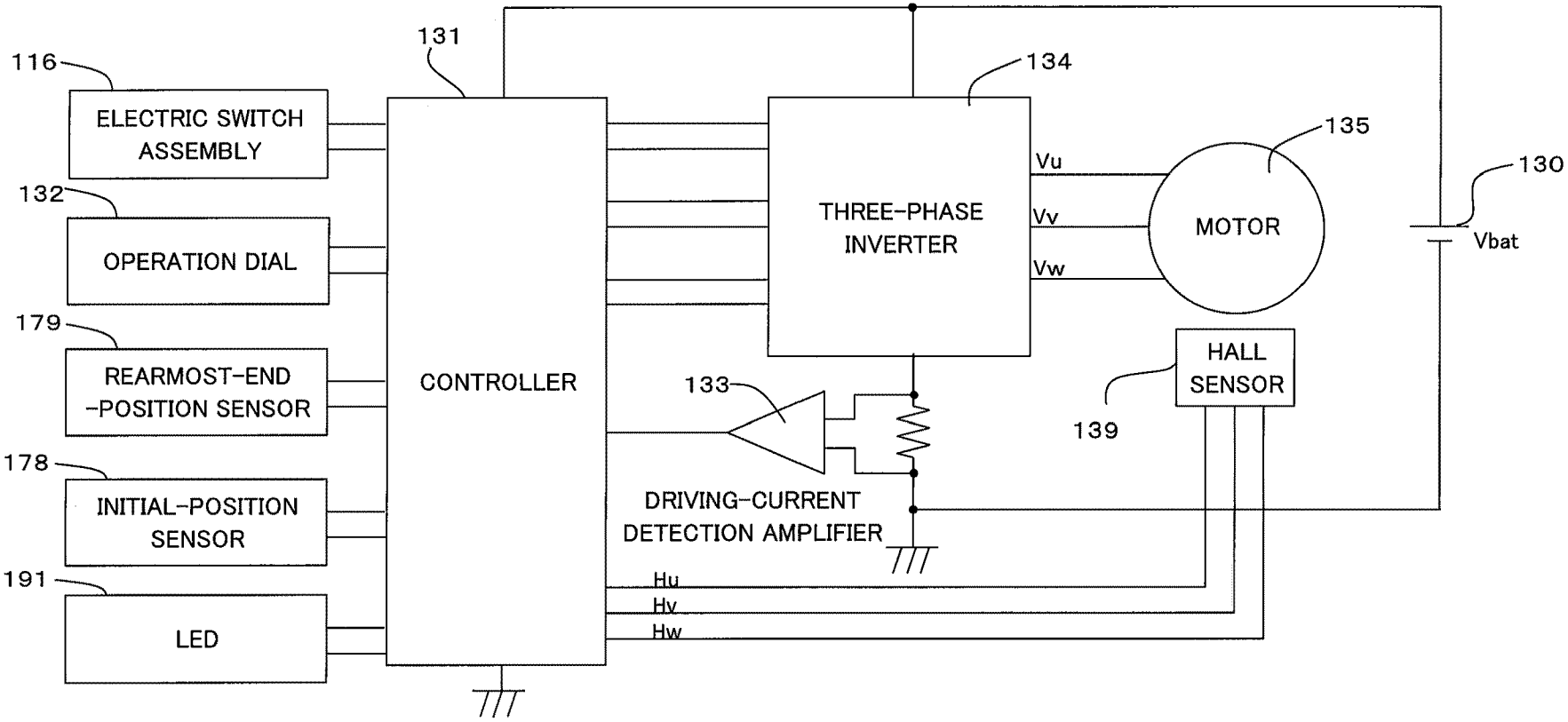
FIG. 6 is a block diagram schematically showing the structure of a motor-drive-control mechanism of the fastening tool.

FIG. 6 is a block diagram showing the electric configuration of a motor-drive-control mechanism 101 of the fastening tool 100 according to the present embodiment. The motor-drive-control mechanism 101 mainly includes a controller 131, a three-phase inverter 134, the motor 135 and the battery 130. The controller 131 is an example that corresponds to the "control part" according to the present invention. Detection signals from the electric switch assembly 116, the operation dial 132, the initial-position sensor 178, the rearmost-end-position sensor 179, and a driving-current detection amplifier 133 for the motor 135 may be inputted to the controller 131. Further, the LED 191 is connected to the controller 131 and emits light to indicate to a user when swaging operation is completed.

The driving-current detection amplifier 133 is configured to convert driving current of the motor 135 into voltage by shunt resistance and outputs a signal amplified by the amplifier to the controller 131.

In the present embodiment, a DC brushless motor which is compact and has relatively high output is employed as the motor 135, and the rotor angle of the motor 135 is detected by Hall sensors 139 and detected values obtained by the Hall sensors 139 are transmitted to the controller 131. Further, in the present embodiment, the three-phase inverter 134 is configured to drive the brushless motor 135 by a 120-degree rectangular wave energization drive system.

Operation of the fastening tool 100 according to the present embodiment is now described.

Figure 7:
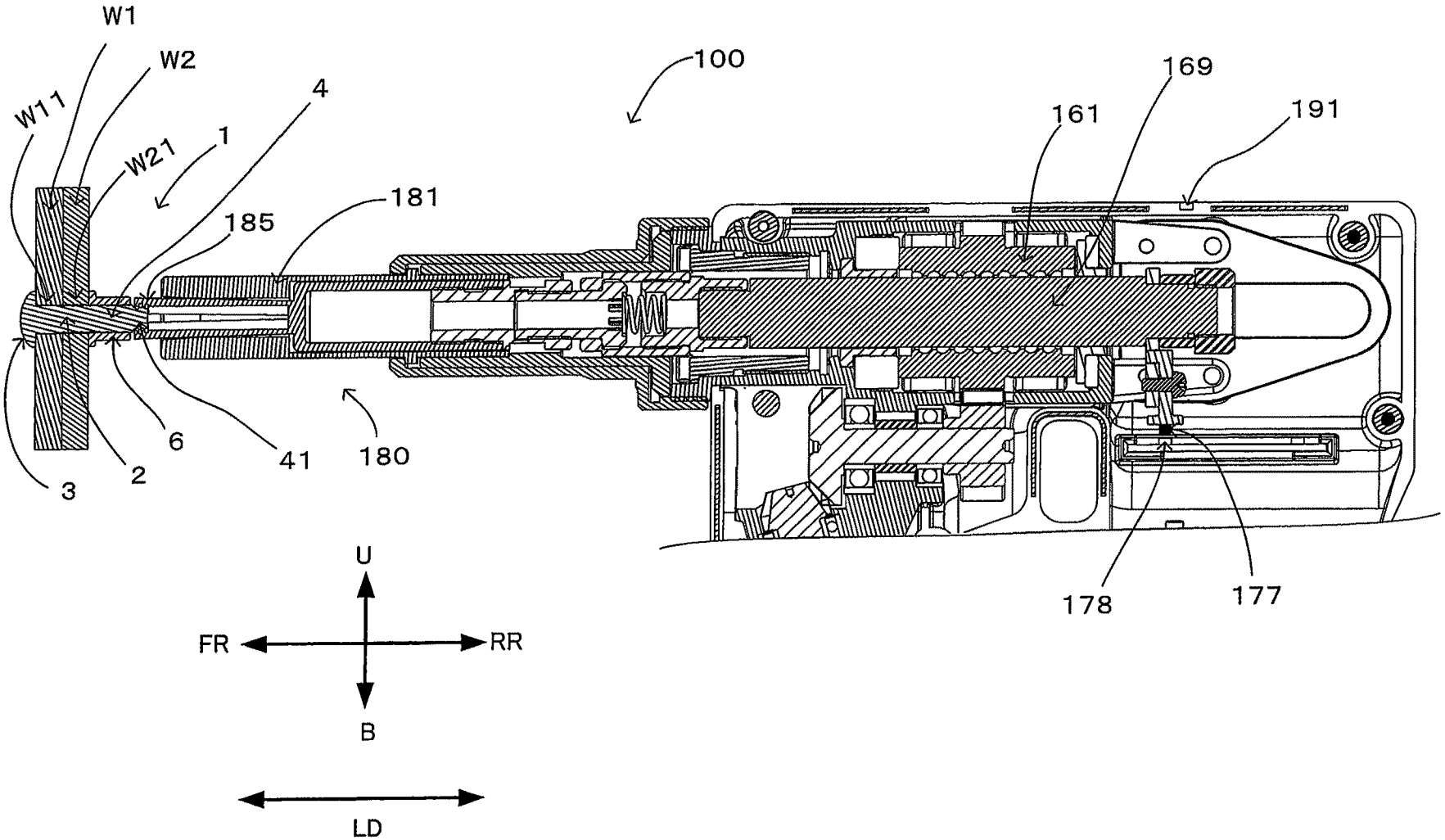
FIG. 7 is a partial sectional view showing an operation state of the fastening tool.

As shown in FIG. 7, a user inserts the bolt shaft 4 of the bolt 2 through the through holes W11 and W21 with the members W1 and W2 to be fastened being superimposed one on the other. Then the user engages the collar 6 with the bolt shaft 4 protruding to the member W2 side with the head 3 being in abutment with the member W1 to be fastened and clamps (preliminarily assembles) the workpiece W between the head 3 and the collar 6.

In this preliminary assembled state, the user holds the fastening tool 100 with hand and engages the bolt-gripping claws 185 of the fastening tool 100 with the bolt-shaft end region 41. At this time, owing to the grooves 5 which are formed substantially over the whole length of the bolt shaft 4 and a particularly large groove in the bolt-shaft end region 41 (see FIG. 1), the bolt-gripping claws 185 can be readily and reliably engaged with the bolt-shaft end region 41.

FIG. 7 shows a state in which the bolt-gripping claws 185 grip the bolt-shaft end region 41, that is, an initial state of the fastening operation. A position of the bolt-gripping claws 185 relative to the anvil 181 in this initial state is an example that corresponds to the "initial position" according to the present invention.

In this initial state of the fastening operation, the magnet 177 connected to the ball-screw shaft 169 is located in the position corresponding to the initial-position sensor 178 in the longitudinal-axis direction LD.

When the user manually turns on the trigger 115 (see FIG. 2) in the initial state, the electric switch assembly 116 is switched on and the controller 131 drives the motor 135 to normally rotate via the three-phase inverter 134. The manner of "normal rotation" here refers to the driving manner in which the ball-screw shaft 169 moves in the rear side direction RR and thereby the bolt-gripping claws 185 move in the rear side direction RR.

In the present embodiment, in the normal rotation driving of the motor 135, a target current value is set via the above-described operation dial 132 (see FIG. 6). Then, the controller 131 controls the driving current of the motor 135 which is detected via the driving-current detection amplifier 133 to become the target current value while the swaging operation is performed.

As the target current value, a value may be adopted which is suitable to satisfy both requirements of securing output necessary and sufficient to fasten the fastener 1 and avoiding the risk of breakage of the fastener 1 (or the bolt-gripping mechanism 180).

Figure 8:
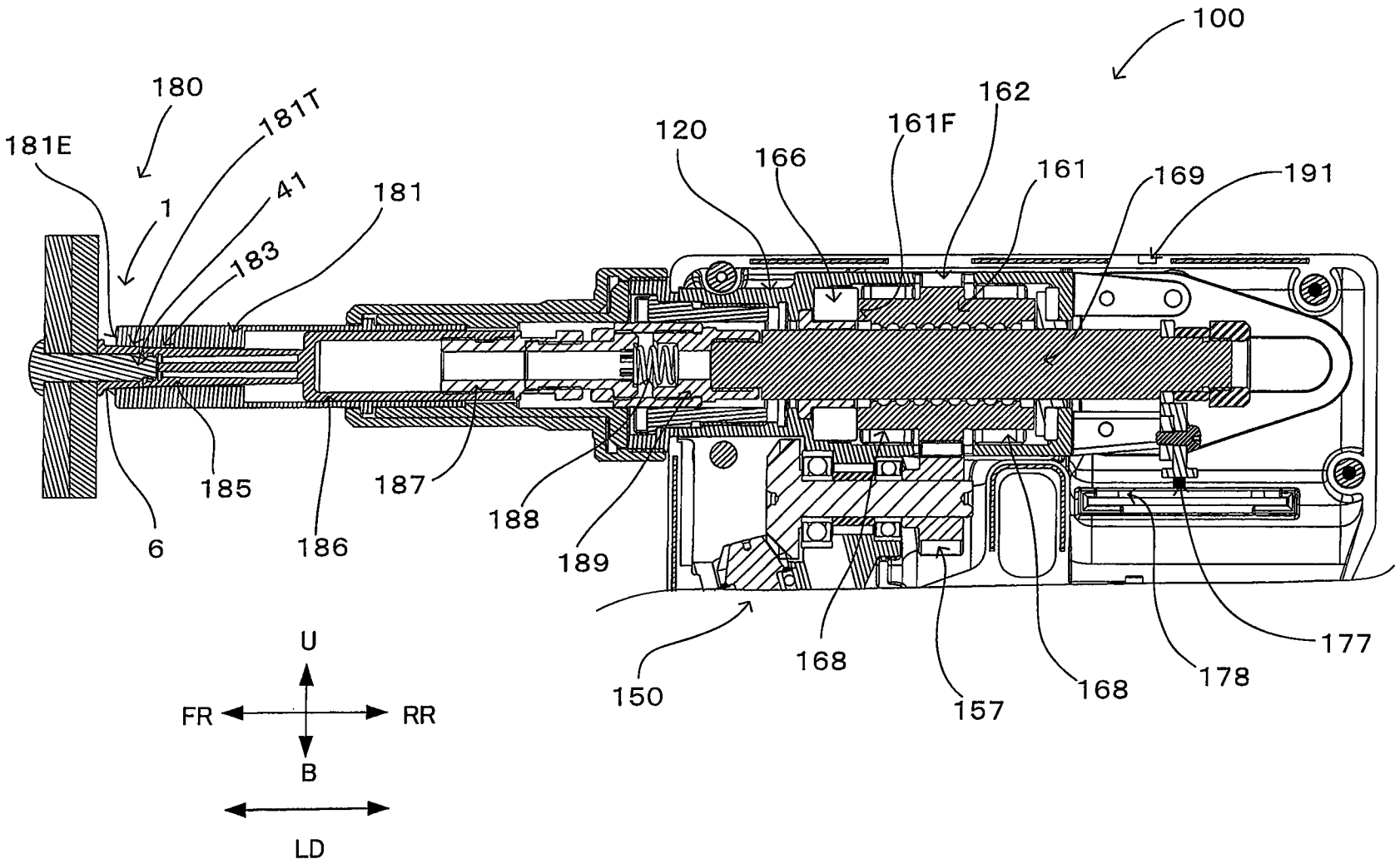
FIG. 8 is a partial sectional view showing an operation state of the fastening tool.

As shown in FIG. 8, when the motor 135 is driven to normally rotate, the driven gear 162 engaged with the ball-nut drive gear 157, which is a final gear in the bevel-gear speed-reducing mechanism 150, is rotationally driven, and thereby the ball nut 161 is rotationally driven in a normal direction (clockwise direction as viewed toward the front side direction FR from the rear side direction RR) around the longitudinal-axis direction LD.

The ball nut 161 has a ball-rolling groove formed in a spiral direction as a right-hand screw. When the ball nut 161 is rotated in the normal direction, the ball-screw shaft 169 moves in the rear side direction RR while converting rotation of the ball nut 161 into linear motion. At this time, the bolt-gripping claws 185 also move in the rear side direction RR together with the ball-screw shaft 169. The magnet 177 connected to the ball-screw shaft 169 moves away from the initial-position sensor 178 in the rear side direction RR and out of the detection range of the initial-position sensor 178.

As the bolt-gripping claws 185 move from the initial position in the rear side direction RR, the bolt-shaft end region 41 engaged and gripped by the bolt-gripping claws 185 is pulled in the rear side direction RR. Although the outer diameter of the collar 6 is slightly larger than the diameter of the anvil bore 183, as the bolt-gripping claws 185 strongly pull the bolt-shaft end region 41 in the rear side direction RR, the collar 6 abuts on the anvil 181 and is pressed in the front side direction FR and inward in the radial direction of the collar 6. Thus, swaging operation is actually started (also referred to as load start).

As the bolt-gripping claws 185 further move in the rear side direction RR after swaging operation is started, the collar 6 enters the tapered part 181T of the anvil bore 183 from the opening 181 while being reduced in diameter. When entering the tapered part 181T, the collar 6 is pressed in the front side direction FR and inward in the radial direction of the collar 6 and deformed, corresponding to a longitudinal-axis direction component and a radial direction component of the inclination angle $\alpha$ (see FIG. 4) of the tapered part 181T.

Figure 9:
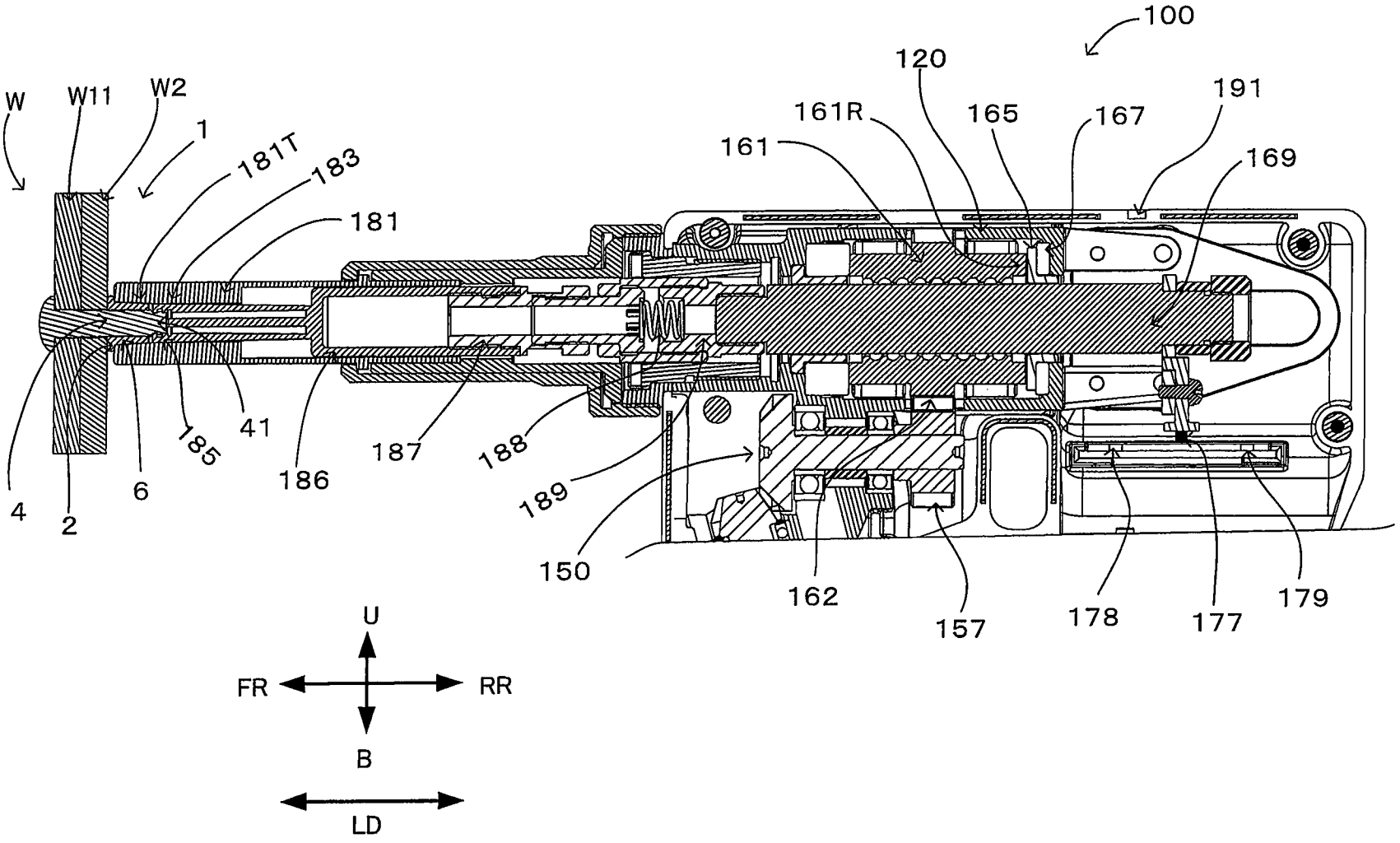
FIG. 9 is a partial sectional view showing an operation state of the fastening tool.

As shown in FIG. 9, as the ball nut 161 is further rotationally driven in the normal direction and the ball-screw shaft 169 moves in the rear side direction RR, the bolt-gripping claws 185 further pull the bolt-shaft end region 41 in the rear side direction RR from the state shown in FIG. 8. Thus, the collar 6 engaged in the anvil 181 proceeds deeper into the tapered part 181T. As a result, the collar 6 is further pressed strongly in the front side direction FR and inward in the radial direction of the collar 6, and the hollow collar part 7 formed as a smooth surface is firmly crimped (swaged) into the grooves 5 (see FIG. 1) formed in the bolt shaft 4. By this crimping, the hollow collar part 7 is engaged into the grooves 5 by plastic deformation. Thus, swaging of the fastener 1 is completed while the bolt-shaft end region 41 remains integrated with the bolt shaft 4, and the operation of fastening the workpiece W is completed.

In the process leading to completion of the fastening operation, as shown in FIG. 9, the collar 6 becomes unable to proceed any deeper into the anvil bore 183 (enters a final stage of the fastening operation) before the magnet 177, which has moved away from the initial-position sensor 178, comes close to the rearmost-end-position sensor 179 in the longitudinal-axis direction LD. As a result, rotation speed of the motor 135 is reduced.

The controller 131 shown in FIG. 6 compares the rotation speed of the motor 135 inputted from the Hall sensors 139 with a preset specified rotation speed value (hereinafter referred to merely as a set value). When the rotation speed of the motor 135 is lower than the set value, the controller 135 determines that the fastening operation by swaging is completed and stops the motor 135 via the three-phase inverter 134.

At this time, the LED 191 provided on the upper surface of the outer housing 110 emits light to indicate to the user that the fastening operation by swaging is completed. Further, apart from indication by LED light emission like in the present embodiment, various kinds of indication such as visual indication by image display, etc., indication by sound and tactile indication by vibration, etc. may also be adopted.

In the present embodiment, it is determined that the swaging operation is completed when the rotation speed of the motor 135 is reduced to be lower than the specified set value. However, it may also be configured such that swaging operation is completed when the rotation speed of the motor 135 is reduced to zero.

In the present embodiment, the driving current of the motor 135 is controlled to become the target current value to optimize output management during the swaging operation, so that the fastening operation is completed while the fastener 1 shown in FIG. 1 remains integrated with the bolt shaft 4. Further, with the output being optimized by setting the target current value, the bolt-gripping claws 185 can be avoided from gripping and driving the bolt-shaft end region 41 strongly more than necessary, so that thorough protection of the bolt 2 can be ensured. In this manner, such an accident that the bolt-gripping claws 185 damage the bolt-shaft end region 41 can be prevented and the need for an additional process such as re-coating can be eliminated, so that working efficiency is improved.

FIG. 9 shows the fastening tool 100 which has completed the fastening operation by swaging as described above. In order to make the fastening tool 100 ready for the next fastening operation, it is necessary to return the fastening tool 100 from the operation-completed state shown in FIG. 9 to the initial state shown in FIG. 7 and separate the collar 6 swaged to the bolt 2 from the anvil 181.

In the present embodiment, when the fastening operation is completed and the user turns off the trigger 115 (see FIG. 2), the controller 131 shown in FIG. 6 drives the motor 135 to reversely rotate via the three-phase inverter 134.

In the present embodiment, the motor 135 is controlled to reversely rotate based on a specified target rotation speed. As described above, in the swaging operation of the fastener 1, the driving current of the motor 135 is controlled to become the specified target current value in order to secure output required for swaging while preventing breakage of the bolt 2 (or the bolt-gripping claws 185). However, when returning to the initial state by driving the motor 135 to reversely rotate after completion of swaging, it may be rather reasonable to speed up the return operation as much as possible. In consideration of this point, when the fastening operation is completed and the trigger 115 is turned off, the control part reversely rotates the motor 135 while controlling the motor 135 to drive at the specified target rotation speed.

This reverse rotation of the motor 135 is transmitted to the ball nut 161 via the driven gear 162 which is engaged with the ball-nut drive gear 157 of the bevel-gear speed-reducing mechanism. Thus, the ball-screw shaft 169 moves in the front side direction FR and the bolt-gripping claws 185 also move in the front side direction FR together with the ball-screw shaft 169. At this time, a considerably strong load is required to separate the collar 6 from the anvil 181 since the collar 6 is firmly stuck to the anvil bore 183 due to a strong load applied when the collar 6 was swaged. The load is applied to the ball nut 161 as an axial force in the rear side direction RR via the bolt-gripping claws 185, the bolt-gripping-claw base 186, the first connection part 187A, the second connection part 187B, the locking part 188, the third connection part 189 and the ball-screw shaft 169.

In the present embodiment, the rear end part 161R of the ball nut 161 is supported by the inner housing 120 via (the thrust washer 165 and) the thrust needle bearing 167. Therefore, the thrust needle bearing 167 reliably receives the axial force in the rear side direction RR while rolling around the longitudinal-axis direction LD so as to allow the ball nut 161 to rotate, thereby preventing this axial force from impeding smooth rotation of the ball nut 161.

In the present embodiment, the maximum movable range of the ball-screw shaft 169 shown in FIG. 4 in the longitudinal-axis direction LD is set to correspond to the distance between the initial-position sensor 178 and the rearmost-end-position sensor 179. In other words, the distance of movement of the magnet 177 from the position corresponding to the initial-position sensor 178 to the position corresponding to the rearmost-end-position sensor 179 is given as the maximum movable range of the ball-screw shaft 169. For example, if the trigger 115 is turned on when the bolt-gripping claws 185 are not engaged with the bolt 2, the ball-screw shaft 169 can move in the rear side direction RR until the magnet 177 reaches the rearmost-end-position sensor 179. The state in which the magnet 177 has reached the rearmost-end-position sensor 179 is defined as a state in which the fastening tool 100 is in a "stop position".

On the other hand, when the bolt-gripping claws 185 grip the bolt 2 of the fastener 1 and the above-described fastening operation by swaging is performed, in the process leading to completion of the fastening operation, the rotation speed of the motor 135 is reduced to below the specified set value. Accordingly, the motor 135 is controlled to stop before the magnet 177 reaches the detection range of the rearmost-end-position sensor 179.

Figure 10:
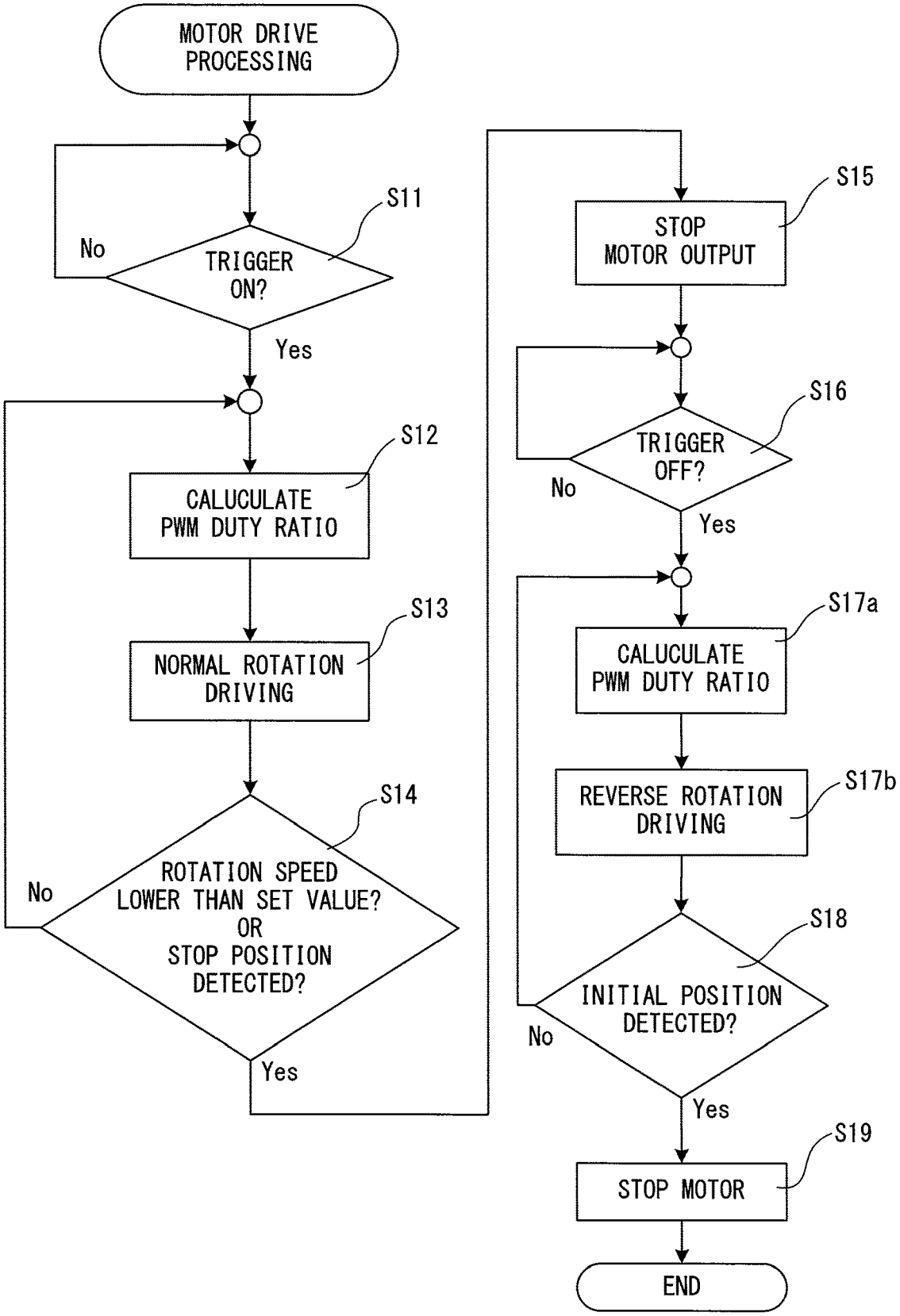
FIG. 10 is a flow chart showing processing steps in the motor-drive-control mechanism.

FIG. 10 shows an overview of a drive control flow in the motor-drive-control mechanism 101. Determination in the drive control flow is made by the controller 131 unless noted otherwise, and reference signs for components which are used in FIGS. 1 to 9 are also used in the following description and not shown in FIG. 10.

In a motor drive control routine, first in step S11, the on/off state of the trigger 115 and the electric switch assembly 116 is monitored. When the on state of the trigger 115 is detected, in step S12, a duty ratio for driving the motor 135 is calculated and a PWM signal is generated in the three-phase inverter 134, and in step S13, the motor 135 is driven to normally rotate. As described above, in the present embodiment, the driving current of the motor 135 is controlled to become a specified target current value, which will be described in detail later as the "motor drive control processing based on the target current value".

The "normal rotation" of the motor 135 corresponds to the linear movement of the ball-screw shaft 169 shown in FIG. 4 in the rear side direction RR and movement of the bolt-gripping claws 185 in the rear side direction RR relative to the anvil 181. By the normal rotation of the motor 135 in step S13, the collar 6 is swaged to the bolt 2 in the fastener 1 shown in FIG. 1.

In step S14, it is determined whether the fastening operation is completed, according to whether the above-described rotation speed of the motor 135 is reduced to below the specified set value, or whether the magnet 177 reaches the rearmost-end-position sensor 179 (or is located in the stop position). If completion of the fastening operation or the stop position is detected in step S14, output of the motor 135 is stopped in step S15. Further, although particularly not shown in the flow chart, the controller 131 causes the LED 191 to emit light to indicate to the user that the fastening operation is completed.

Subsequently, if a user's operation of turning off the trigger is detected in step S16, a duty ratio for driving the motor 135 to reversely rotate is calculated and a PWM signal is generated in step S17*a*, and the motor 135 is driven to reversely rotate in step S17*b*. This reverse rotation driving is performed by controlling the motor 135 to drive at the specified target rotation speed as described above, and is continued until the magnet 177 reaches the initial-position sensor 178. When the initial position is detected in step S18, the motor 135 is stopped by an electric brake (step S19) and the motor drive processing is completed.

In the reverse rotation driving of the motor 135 at the target rotation speed in the above-described step S17*b*, the driving current of the motor 135 may be detected in preparation for malfunction of the initial-position sensor 178, and when the detected driving current of the motor 135 exceeds a specified threshold, a processing for stopping the motor 135 even without a detection signal from the initial-position sensor 178 may be additionally provided in order to ensure thorough equipment protection.

Figure 11:
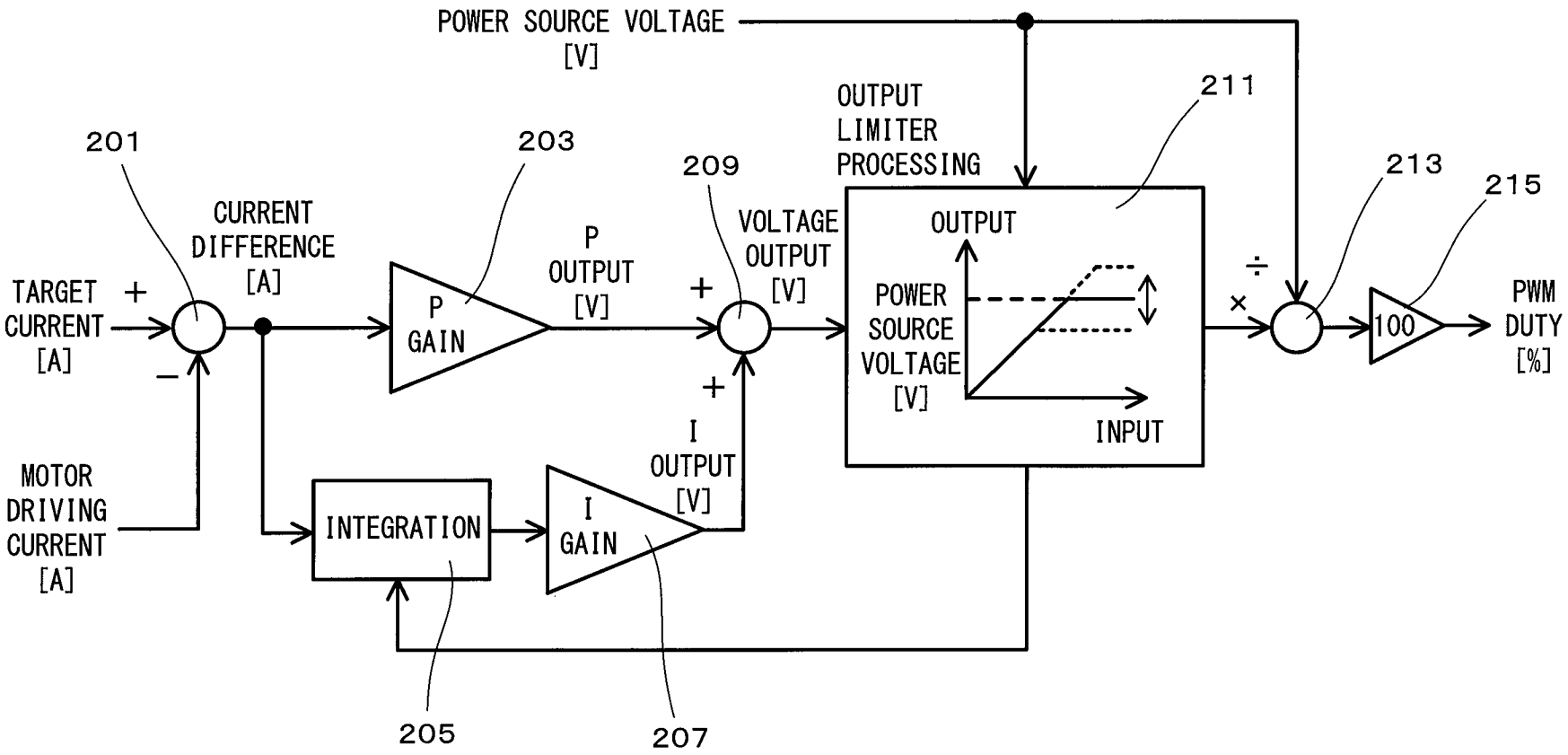
FIG. 11 is a block diagram showing motor drive control processing based on a target current.

Next, the "motor drive control processing based on the target current value" in the normal rotation of the motor is explained with reference to the block diagram showing the motor drive control in FIG. 11. Further, any of the motor drive control processing is performed by processing elements in the controller 131 (or the three-phase inverter 134) shown in FIG. 6. As shown in FIG. 11, in a summing point 201, a current difference value (A: ampere) is obtained by summing the target current value (A: ampere) as a positive value and the motor driving current value (A) as a negative value. The current difference value (A) is subjected to P gain (proportional gain) processing in an amplifier 203, which forms a proportional element, and a P output (proportional output) (V: voltage) is obtained as a voltage value.

Further, in an integration processing section 205 and an amplifier 207, which form integral elements, the current difference value (A) is subjected to integral processing and I gain (integral gain) processing, and I output (integral output) (V: voltage) is obtained as a (integral) voltage value. In a summing point 209, voltage output (V: voltage) (as PI output) is obtained by summing the P output and the I output. This voltage output (V) corresponds to a so-called PI (proportional-integral) operation in the control system and also has an effect of correcting steady-state deviation. The voltage output (V) is then transmitted to an output limiter processing section 211.

The above-described voltage output (V) is adjusted based on power supply voltage (V: voltage) (voltage value of the battery 130 shown in FIG. 2 in the present embodiment) in the output limiter processing section 211 and then transmitted to a summing point 213. The output limiter processing section 211 serves to proportionally divide the voltage output (V) according to the power supply voltage (V) and is also capable of effectively coping with an influence of voltage drop and fluctuations in a power source. The voltage output which is adjusted in the output limiter processing section 211 is subjected to processing of calculating a ratio to the power supply voltage (V) in the summing point 213 and further converted into percentage in an amplifier 215, so that a duty ratio for driving the motor 135 is calculated and a PWM signal is generated.

In the present embodiment, as shown in FIG. 11, the voltage output (V) in the output limiter processing section 211 is fed back to the integration processing section 205 as a part of feedback control. This feedback is performed when the voltage output (V) is zero V or lower and equal to or higher than the power supply voltage (V). Further, in the integration processing section 205 to which the voltage output is fed back, integral processing is prohibited according to the above-described current difference (A) during output saturation, so that the above-described PI operation is performed only when the driving current of the motor 135 does not reach the target current value.

In the present embodiment, the current difference between the driving current of the motor 135 and the target current value is converted into voltage output to thereby perform control processing to cope with voltage drop of the power supply, but in this processing step, the output duty ratio may be directly calculated from the current difference to generate a PWM signal without converting the current difference into voltage output.

Figure 12:
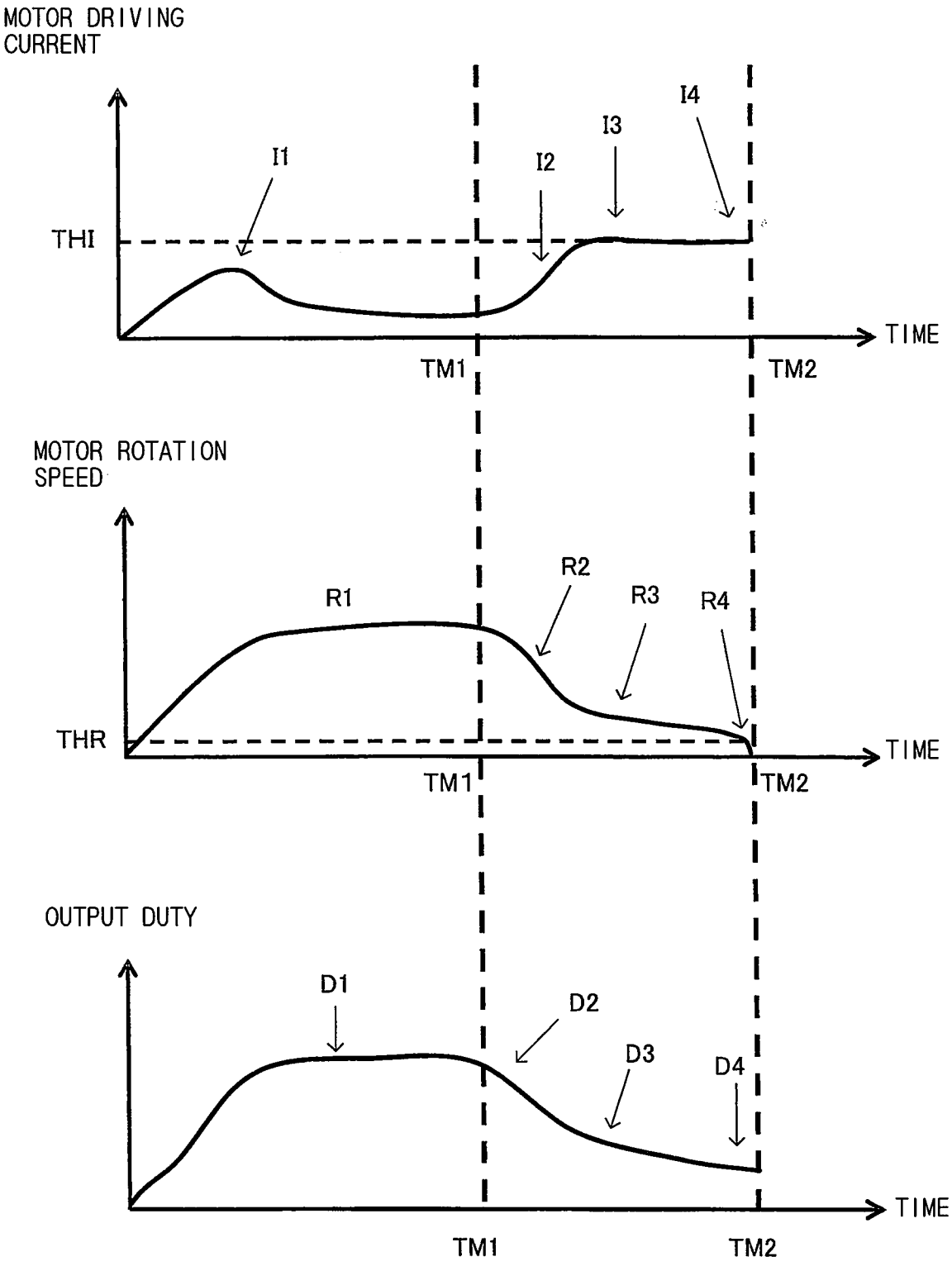
FIG. 12 is a composite graph showing changes with time of motor driving current, motor rotation speed and output duty for driving the motor.

FIG. 12 shows changes in the motor driving current, motor rotation speed and output duty ratio for driving the motor in the fastening operation performed via the above-described motor drive control processing. FIG. 12 is a composite graph showing changes with time in the driving current, rotation speed and output duty of the motor 135 during the fastening operation (specifically, during normal rotation driving of the motor). THI in a vertical axis of an upper graph (showing a change with time in the driving current of the motor 135) is the target current value of the driving current of the motor 135. TM1 in a horizontal axis of the graph is the time when the swaging operation is actually started, or more specifically, corresponds to the load start time when a series of operation of pressing the collar 6 is started in which the collar 6 abuts on the anvil 181 and is thus stopped from further moving and thereafter proceeds into the tapered part 181T while being reduced in diameter, as shown in FIG. 8. Further, TM2 is the fastening completion time, which is the time when the rotation speed of the motor is reduced to below the set value so that the fastening operation is determined as being completed and the output of the motor 135 is stopped (see also step S15 of FIG. 10).

As described with reference to FIG. 10, when the on-state of the trigger 115 is detected in step S11, the driving current control processing is performed such that the driving current of the motor becomes the specified target current value in step S12. As shown in FIG. 12, relatively large starting current is generated in an initial driving stage of the motor 135 (in I1 area in the upper graph), but does not reach the target current value THI, so that any control is not particularly performed based on the target current value THI. Thereafter, from the time TM1 which corresponds to the load start time when the swaging operation is actually started, the driving current value increases (in I2 area) corresponding to increase of output required for swaging. When this is viewed based on the rotation speed of the motor 135, the motor rotation speed initially remains at relatively high speed in R1 area and is reduced from the time TM1, that is, the load start time, along with increase of output required for swaging (in R2 area in a middle graph).

As described above, in the present embodiment, the swaging operation is performed while the driving current of the motor 135 is controlled to become the target current value. Meanwhile, the driving current of the motor 135 remains at the target current value THI (in I3 area in the upper graph). During the swaging operation, the driving current of the motor 135 steadily remains at the target current value THI, so that the rotation speed of the motor 135 is reduced in inverse correlation to increase of required output. This state is shown in R2 and R3 areas in the middle graph.

As shown in the upper graph, in I3 area, the driving current of the motor 135 is controlled to be the target current value THI. This driving current control is maintained even in a process near completion of the swaging operation which leads to the state in which the collar 6 cannot plastically deform any further. Meanwhile, the rotation speed of the motor 135 is gradually reduced as it gets difficult to further press the collar 6. The state in which the rotation speed of the motor 135 is gradually reduced is shown in R3 area of the middle graph.

When the rotation speed of the motor 135 is determined as being lower than the specified set value as shown in step S14 of FIG. 10, that is, when the rotation speed of the motor 135 is reduced to below the set value THR in R4 area as shown in the middle graph of FIG. 12, the fastening operation is determined as being completed and output of the motor 135 is stopped at time TM2.

The lower graph of FIG. 12 shows the change in the output duty for driving the motor 135 from detection of the turning-on operation of the trigger 115 until completion of the fastening operation via start of the swaging operation. In the lower graph, an initial stage of the output duty before the swaging operation is actually started is shown in D1 area, and the state in which the output duty is reduced in response to control based on the target current value after the load start time TM1 is shown in D2 to D4 areas.

In the present embodiment, the driving current of the motor 135 is controlled to become the specified target current value THI from detection of the turning-on operation of the trigger 115 until completion of swaging operation. However, the control may be based on a different target current value until the load start time TM1 after detection of the turning-on operation of the trigger 115, and the control based on the target current value THI may be performed from the time TM1 until completion of swaging operation. Alternatively, until the load start time TM1 after detection of the turning-on operation of the trigger 115, the drive control may be based, for example, on a target rotation speed in place of the target current value. Further, the control based on the target current value THI may be performed only just before completion of swaging operation, and in the other areas, other drive control (for example, drive control based on a target rotation speed) may be performed.

Figure 13:
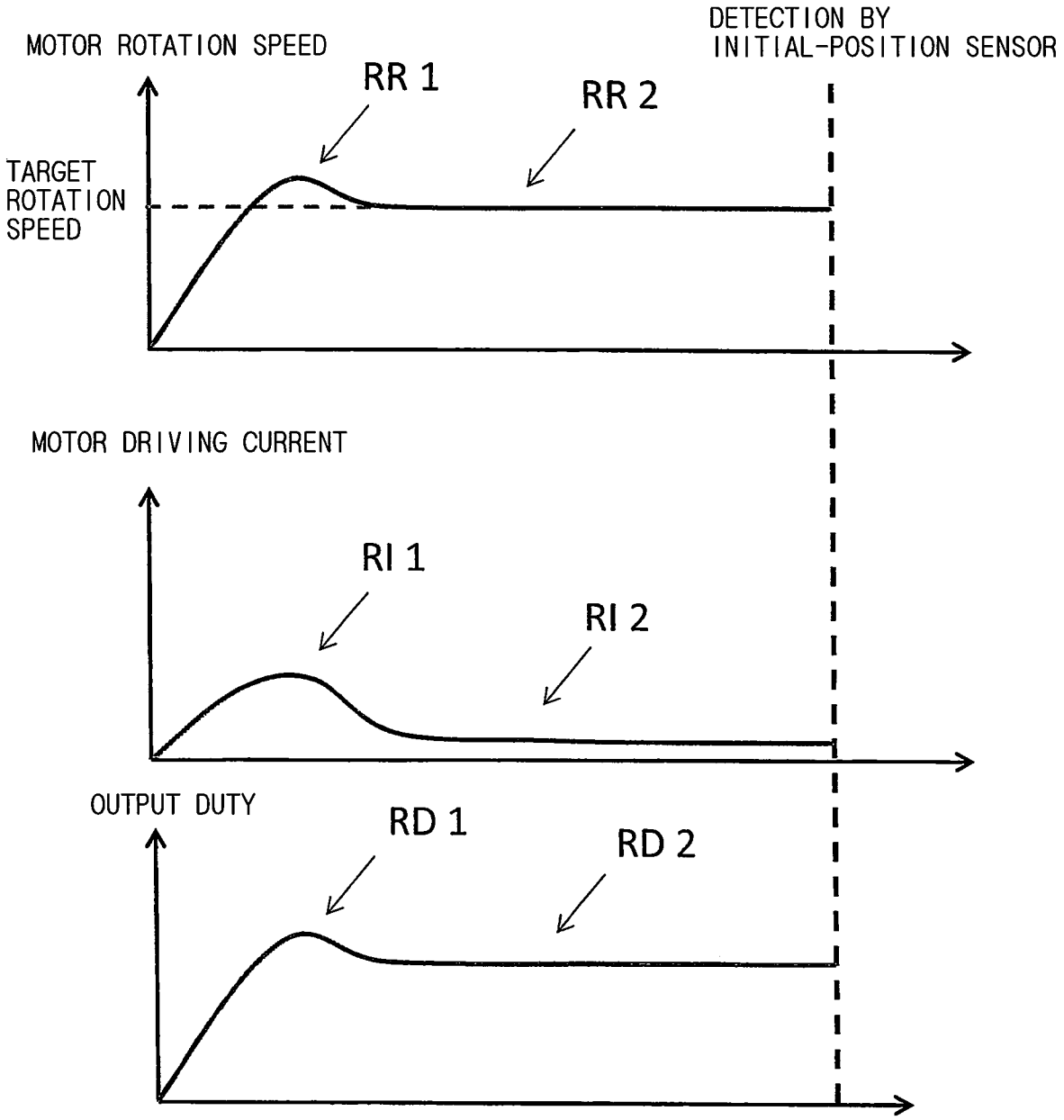
FIG. 13 is a composite graph showing changes with time of the motor rotation speed and motor driving current and output duty ratio for driving the motor, during reverse rotation driving of the motor.

FIG. 13 shows changes in the motor rotation speed, motor driving current and output duty for driving the motor when the motor 135 is driven to reversely rotate at the target rotation speed after completion of swaging.

During the reverse rotation driving of the motor, as shown in an upper graph of FIG. 13, in RR1 area, the motor rotation speed rises to the target rotation speed and an overshoot of the rotation speed changes to converge to the target rotation speed by the feedback control, and then in RR2 area, the motor is stably driven to reversely rotate at the target rotation speed. Further, in a middle graph of FIG. 13, a change in the motor driving current corresponding to such target rotation speed is shown in RI1 and RI2 areas. In a lower graph of FIG. 13, a change in the output duty corresponding to such target rotation speed is shown in RD1 and RD2 areas.

In light of the above-described structures and operations, according to the present embodiment, the fastening tool 100 is realized which is capable of completing swaging the fastener 1 while the bolt-shaft end region 41 remains integrated with the bolt shaft 4 without being broken, and has a rational compact structure which is capable of closely managing the axial force. Each of the above-described embodiments is capable of closely managing the axial force alone, or more closely in appropriate combination with the other.

A modification to the drive control flow in the motor-drive-control mechanism 101 is now described with reference to FIG. 14. This modification corresponds to a control flow in which step S16 is omitted from the drive control flow shown in FIG. 10. Therefore, in FIG. 14, steps identical to those of the drive control flow of FIG. 10 are given the same step numbers.

Figure 14:
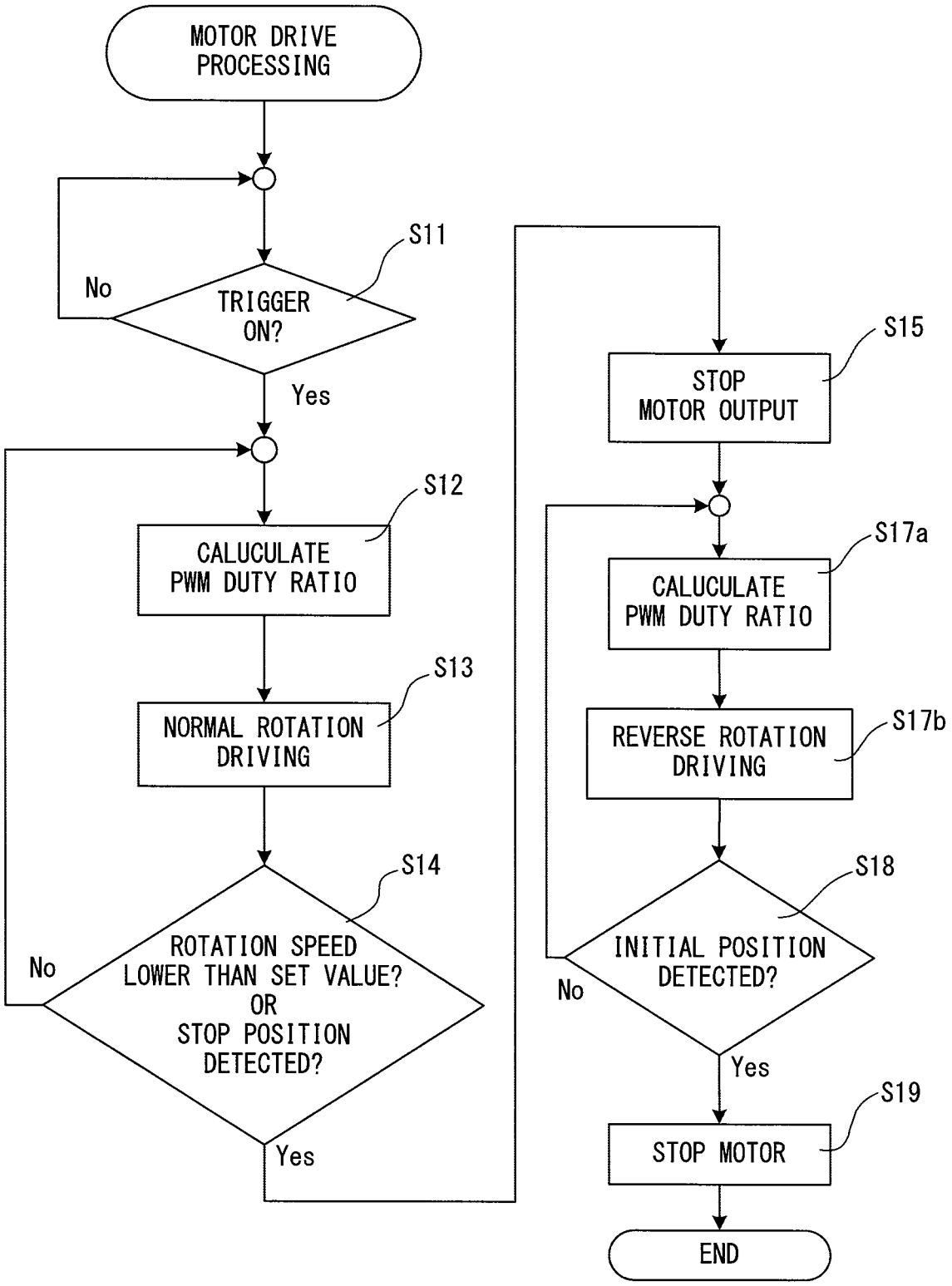
FIG. 14 is a flow chart showing a modification to the processing steps in the motor-drive-control mechanism.

As shown in FIG. 14, in this modification like in the above-described embodiment, after the on-state of the trigger 115 (the electric switch assembly 116) is detected, swaging operation is performed through motor drive control processing based on a target current (in step S11 to step S13). Then, when the rotation speed of the motor 135 is reduced to below a specified set value, or when the ball-screw shaft 169 reaches the stop position (when the magnet 177 is detected by the rearmost-end-position sensor 179), output of the motor 135 is stopped (in step S14 and step S15). In this modification, when the motor is stopped in step S15, the motor 135 is immediately driven to reversely rotate by the controller 131 (or the three-phase inverter 134) (in step S17*a* and step S17*b*). Specifically, the bolt-gripping claws 185 are moved in the front side direction FR relative to the anvil 181. Thereafter, when the bolt-gripping claws 185 are returned to the initial position (when the magnet 177 is detected by the initial-position sensor 178), the motor 135 is stopped (in step S18 and step S19).

As explained above, in this modification, after stopping movement of the bolt-gripping claws 185 in the rear side direction RR, the controller 131 automatically starts movement of the bolt-gripping claws 185 in the front side direction FR and returns the bolt-gripping claws 185 to the initial position. Specifically, the controller 131 returns the bolt-gripping claws 185 to the initial position without waiting for the trigger 115 (the electric switch assembly 116) to be turned off. Therefore, in this modification, in addition to the effect obtained by the same control processing as that in the above-described embodiment, working efficiency can be improved when the fastening operation using the fastener 1 is continuously performed a plurality of times. It is noted that the controller 131 may start the movement of the bolt-gripping claws 185 in the front side direction FR after the lapse of a specified period of time (a preset relatively short period of time) after stopping the movement of the bolt-gripping claws 185 in the rear side direction RR.

In view of the nature of the present invention and the present embodiments, the following features may be appropriately employed. Further additional features could be employed by adding any one of the following features alone or adding a combination of two or more of the following features to each of the claimed inventions.

(Aspect 1)

"The control part completes swaging of the fastener by stopping driving of the bolt-gripping part based on an amount of change in rotation speed of the motor."

Quickness of control can be improved by controlling based on the amount of change in the rotation speed of the motor.

(Aspect 2)

"An indication part for indicating completion of swaging of the fastener is provided."

Working efficiency can be further improved by indicating to a user of the fastening tool completion of fastening. As a manner of indication, apart from indication by LED light emission like in the present embodiment, various kinds of indication including visual indication such as by image display, indication by sound and tactile indication such as by vibration may also be adopted.

As for the timing of indication by the indication part, alternatively or in addition to the time of completion of fastening, the time of turning-on operation, and/or the load start time, and/or the time of return to the initial position after fastening operation or any other timing may also be appropriately adopted to indicate to a user.

(Aspect 3)

"The bolt-gripping part is driven in the first direction while the driving current of the motor is controlled to become a specified target current value at least just before completion of swaging of the fastener."

Control is performed based on the target current value at the time just before completion of swaging operation when output particularly easily increases, thereby realizing more rational fastening operation while ensuring thorough equipment protection.

(Aspect 4)

"The control part calculates voltage output based on a difference between a driving current value of the motor and the target current value and controls driving of the motor based on comparison between the voltage output and power supply voltage of the motor."

The motor drive control can be performed in consideration of fluctuations of power supply voltage, so that the risk of a control trouble caused due to disturbance during fastening operation is reduced.

DESCRIPTION OF THE NUMERALS

W: workpiece
W1, W2: member to be fastened
W11, W21: through hole
1: fastener
2: bolt
3: head
4: bolt shaft
41: bolt-shaft end region
5: groove
6: collar
7: hollow collar part
100: fastening tool
101: motor-drive-control mechanism
110: outer housing
111: motor housing region
112: speed-reducing-gear housing region
113: inner-housing housing region
114: grip part
115: trigger
116: electric switch assembly
117: controller housing region
118: battery mounting part
120: inner housing
120H: hole
121: ball-screw mechanism housing region
122: guide flange mounting arm
123: guide flange
124: guide hole
125: sleeve
126: sleeve bore
127: joint sleeve
130: battery
131: controller
132: operation dial
133: driving-current detection amplifier
134: three-phase inverter
135: motor
136: motor output shaft
137: bearing
138: cooling fan
139: Hall sensor
140: planetary-gear speed-reducing mechanism
141A: first sun gear
142A: first planetary gear
143A: first internal gear
141B: second sun gear
142B: second planetary gear
143B: second internal gear
144: carrier
150: bevel-gear speed-reducing mechanism
151: drive-side intermediate shaft
152: bearing
153: drive-side bevel gear
154: driven-side intermediate shaft
155: bearing
156: driven-side bevel gear
157: ball-nut drive gear
160: ball-screw mechanism
161: ball nut
161F: front end
161R: rear end
162: driven gear
163: bore
164: groove
165: thrust washer
166: thrust ball bearing
167: thrust needle bearing
168: radial needle bearing
169: ball-screw shaft
169L: rotational axis
171: threaded engagement part
172: roller shaft
173: roller
174: end cap
175: arm mounting screw
176: arm
177: magnet
178: initial-position sensor
179: rearmost-end-position sensor
180: bolt-gripping mechanism
181: anvil
181T: tapered part
182: sleeve lock rib
183: anvil bore
185: bolt gripping claw
186: bolt-gripping-claw base
187A: first connection part
187B: second connection part
187C: locking flange
188: locking part
188A: locking end part
189: third connection part
190: space
191: LED
201: summing point
203: amplifier
205: integration processing section
207: amplifier
209: summing point
211: output limiter processing section
213: summing point
215: amplifier

The invention claimed is:

1. A fastening tool, which uses a fastener including a bolt and a cylindrical hollow collar that is engageable with the bolt, the bolt having a head part integrally formed with a shaft part having a groove, to fasten a workpiece between the head part and the collar, the fastening tool comprising:

a bolt-gripping part configured to grip an end region of the shaft part;

an anvil configured to be engaged with the collar; and a motor configured to drive and move the bolt-gripping part relative to the anvil in a specified longitudinal-axis direction;

wherein:

when the bolt-gripping part grips the end region of the shaft part and moves relative to the anvil in a specified first direction of the longitudinal-axis direction, the anvil presses the collar fitted onto the shaft part in a second direction opposite to the first direction of the longitudinal-axis direction and inward in a radial direction of the collar, so that swaging of the fastener is started, the fastening tool is configured to clamp the workpiece between the collar and the head part and to crimp a hollow part of the collar to the groove, whereby swaging of the fastener is completed while the end region remains integrated with the shaft part, and the fastening tool is configured to automatically perform swaging of the fastener by driving the bolt-gripping part in the first direction while controlling driving current of the motor to become a specified target current value, and to complete swaging of the fastener by stopping driving of the bolt-gripping part based on comparison of a rotation speed of the motor to a preset specified rotation speed value.

2. The fastening tool as defined in claim 1, wherein the fastening tool is configured to drive the bolt-gripping part while controlling the driving current of the motor to become the target current value from start to completion of a swaging operation of the fastener.

3. The fastening tool as defined in claim 1, further comprising:

an operation member configured to be manually turned on by a user to drive the motor, wherein:

the fastening tool is configured to drive the bolt-gripping part while controlling the driving current of the motor to become the target current value until swaging of the fastener is completed after the operation member is turned on.

4. The fastening tool as defined in claim 1, wherein the fastening tool is configured to stop driving of the bolt-gripping part to complete swaging of the fastener when the rotation speed of the motor is reduced to the specified rotation speed.

5. The fastening tool as defined in claim 1, wherein the fastening tool is configured to stop driving of the bolt-gripping part to complete swaging of the fastener when the motor stops rotating.

6. The fastening tool as defined in claim 1, wherein the target current value is adjustable.

7. The fastening tool as defined in claim 1, wherein:

an initial position is set in which the bolt-gripping part is placed in a specified position relative to the anvil, and the fastening tool is configured to move the bolt-gripping part in the second direction relative to the anvil, when swaging of the fastener is completed, to return the bolt-gripping part to the initial position by controlling the motor to be driven at a specified target rotation speed.

8. The fastening tool as defined in claim 1, wherein:

an initial position is set in which the bolt-gripping part is placed in a specified position relative to the anvil, and the fastening tool is configured to move the bolt-gripping part in the second direction relative to the anvil to return the bolt-gripping part to the initial position after stopping movement of the bolt-gripping part in the first direction relative to the anvil based on the rotation speed of the motor.

* * * * *